US005676367A

United States Patent [19]

Oshino et al.

[11] Patent Number: 5,676,367

[45] Date of Patent: Oct. 14, 1997

[54] STACKER

[75] Inventors: Genzi Oshino; Katsuhiko Obata, both of Miyagi-ken, Japan

[73] Assignee: Tohoku Ricoh Co., Ltd., Miyagi-ken, Japan

[21] Appl. No.: 475,180

[22] Filed: Jun. 7, 1995

Related U.S. Application Data

[62] Division of Ser. No. 164,750, Dec. 10, 1993, Pat. No. 5,476,233.

[30] Foreign Application Priority Data

Dec. 14, 1992 [JP] Japan ..... 4-333140
Dec. 14, 1992 [JP] Japan ..... 4-333146

[51] Int. Cl.[6] ..... B65H 31/08

[52] U.S. Cl. ..... 271/212; 271/220

[58] Field of Search ..... 271/212, 220–222, 271/160

[56] References Cited

U.S. PATENT DOCUMENTS 3,395,870 8/1968 Klinger .
3,782,658 1/1974 Mischenko .
3,998,451 12/1976 McInerny .
4,161,298 7/1979 Davis .
4,968,023 11/1990 Huggins .
5,195,691 3/1993 Pfeiffer et al. .
5,215,301 6/1993 Oshino et al. .
5,393,046 2/1995 Garbe ..... 271/220

*Primary Examiner*—Boris Milef
*Attorney, Agent, or Firm*—Armstrong, Westerman, Hattori, McLeland & Naughton

[57] ABSTRACT

A press force control apparatus for use in a apparatus for stacking sheets of paper that have been cut from a continuous roll of paper by inserting each successive sheet of paper beneath a previously stacked sheet of paper. The press force control apparatus includes a paper press for pressing a top surface of the sheets of paper, after the sheets of paper have been placed in a stacked position, wherein the paper press is translatable up and down with respect to a stack height of the sheets of paper. The press force control apparatus includes a press force switching facilities for dually functioning to contact the paper press to apply a press force to the paper press and thus hold the paper press in a downwardly translated position, wherein the paper press transfers the press force to the sheets of paper in the stacked position until the stack height of the sheets of paper in the stacked position reaches a predetermined value and to release the press force when the stack height of the sheets of paper exceeds the predetermined value. The press force switching facilities is provided with a mechanism for controlling the stack height at which the press force is released. The press force control apparatus assures that an appropriate press force is always applied to the sheets of paper so that the sheets of paper may be reliably successively stacked on the bottom of the stack.

2 Claims, 17 Drawing Sheets

STACKER

This is a division of application Ser. No. 08/164,750 filed Dec. 10, 1993 now U.S. Pat. No. 5,476,233.

BACKGROUND OF THE INVENTION

1. Field of the Invention

This invention relates to a press force control apparatus for a paper stacker for successively stacking cut papers by inserting a cut paper into the position of the lowest paper of the previously stacked papers and also for winding a continuous roll of paper while successively stacking the cut papers.

2. Prior Art

There is a prior art stacker which includes: a paper receiver having a bottom plate, side plates and a stopper erected on the bottom plant for limiting the feed depth in the paper feed direction; and a paper feed facilities for feeding papers into the paper receiver along the upper surface of the bottom plate. With such an arrangement of the prior art stacker, the papers fed out of a printer or similar, are fed by the paper feed facilities and inserted into the position of the lowest paper of the previously stacked papers on the bottom of the plate and the papers are further fed until the top ends thereof contact the stopper and the papers are successively stacked on the bottom plate.

According to the prior art stacker, a sheet of paper of a continuous roll of paper is cut in a given length and the cut paper alone is stacked. Accordingly, in a case where a continuous paper, wound in a roll, is pulled out and fed into a printer or similar, and the continuous roll of paper is taken out without being cut after the completion of printing, the stacker which is provided at the rear side of the printer or similar is somewhat in the way. Therefore, the stacker needs to be removed from the rear side of the printer or similar when a continuous roll of paper is being collected.

Furthermore, since the continuous roll of paper discharged from the printer or similar cannot be disposed of as it is, an exclusive winding device for winding the continuous roll of paper is additionally provided or else the continuous roll of paper discharged from the printer or similar must be manually rolled up by an operator, if the winding device is not provided.

However, it is troublesome to either remove the stacker every time a continuous roll of paper is collected or to provide the exclusive winding device on which the continuous roll of paper is wound. Furthermore, in a case where the operator must manually wind the continuous roll of paper discharged from the printer or similar an exclusive operator is required since human hands are needed to perform the winding operation.

Still furthermore, according to the prior art stacker, a newly cut paper is inserted beneath the lowest paper of the stacked papers so that a paper force fed by a paper feed facilities needs to be strengthened. In the case where the continuous paper is wound in a roll, the paper remains curly even once discharged from the printer or similar and cut thereafter. If the top end of the cut paper is directed upwardly, while the paper remains curly, there is a likelihood that the paper will be pushed upwardly and forced out from the stopper when the cut paper is fed into the stacker and contacts the stopper at the front end thereof.

In such a case, the stacked papers on the bottom plate are pressed from the top surface thereof by a paper press having a weight attached thereto, thereby restraining the paper from floating. However, in a case where the weight is attached to the paper press, if the number of papers to be stacked on the bottom plate is increased, the weight of the paper press and the weight of the stacked papers act on or are applied to the paper newly inserted beneath the lowest paper of the stacked papers so that an excessive press force in applied to the newly inserted paper. As a result, there is a possibility that the new paper cannot be inserted beneath the lowest paper of the stacked papers.

Such an inconvenience often occurs in a cast where the paper, like a paper 27' illustrated in FIG. 13, has perforations **27*a* in the width direction thereof. That is, as illustrated in FIG. 14, the paper 27' is held between and fed by a roll-in roller 65 and a pinch roller 67 and is inserted beneath the lowest paper 27' of the stacked papers and then fed to the position of a stopper 33. There is a flash 27*b* on the rear side of the paper 27' as illustrated in FIG. 15, which is formed at the time of formation of the perforations 27*a*. In a case where the flash 27*b* is formed on the back side of the paper 27' which is stacked on the bottom plate, if the new paper 27' is inserted beneath the lowest paper of the stacked papers, the front end 27*c* of the new paper 27' hits the flash 27*b* of the lowest paper 27' so that the new paper 27'** cannot be inserted further, which makes stacking impossible.

SUMMARY OF THE INVENTION

It is an object of the present invention to solve the problems of the prior art stacker. That is, the object of the present invention is to make it possible to stack the cut papers and wind a non-cut continuous roll of paper.

Another object of the present invention is to make it possible to stack cut papers in an unstrained manner by inserting a cut paper into the lowest paper position of the previously stacked papers even if the number of papers to be stacked is increased to thereby increase the weight of the stacked papers.

To achieve the above object, the press force control apparatus for a paper stacker of the present invention for successively stacking the cut papers on the bottom plate is characterized by a winding shaft for winding a non-cut continuous roll of paper on a back side plate so as to project substantially perpendicularly to the paper restriction surface of the back side plate.

According to the press force control apparatus for a paper stacker of the present invention having such a structure, the cut paper can be fed onto the bottom plate. Furthermore, in cases where a non-cut continuous roll of paper is discharged from a printer or similar, the paper is merely wound around a winding shaft at the top end portion thereof by removing a detachable stopper so that the continuous roll of paper can be automatically wound around the winding shaft. Accordingly, even in the case of a continuous roll of paper, it is possible to dispense with such troublesome operations as the stacker being removed or an exclusive winding device around which the continuous paper is wound being installed or the continuous paper discharged from the printer being manually wound.

The press force control apparatus for a paper stacker of the present invention having such a winding shaft can be provided with a driving force transmission mechanism for transmitting a rotary driving force from a driving source of a paper feed mechanism which feeds papers to be stacked on the bottom plate to the winding shaft by means of a slip mechanism.

With such an arrangement of a press force control apparatus for a paper stacker of the present invention, the winding shaft is turned to thereby wind the continuous roll of paper therearound the means of a driving force which is transmitted thereto by the slip mechanism. As the diameter of the continuous roll of paper which is wound around the winding shaft is increased, the winding speed of the continuous paper is accelerated, whereby a difference occurs between the winding speed and the discharging speed of the continuous roll of paper when it is discharged from the printer or similar. At this time, since the difference between the winding and discharging speeds can be absorbed by the slip generated in the slip mechanism, the continuous roll of paper can always be wound stably without being cut. At the same time, an appropriate tension is given to the continuous roll of paper to thereby prevent the continuous roll of paper from being slackened.

The driving force for naming the winding shaft is transmitted to the same driving source as that of the paper feed mechanism which feeds the cut papers. Since a single driving source is good enough, this contributes to the low manufacturing cost thereof.

Furthermore, the press force control apparatus for a paper stacker of the present invention having such a winding shaft can be provided with a stacking, winding amount detecting facilities which is positioned at a position where the detecting facilities will not interfere with the winding shaft at the time of stacking of the cut papers, and positioned at the position where the detecting facilities will contact the winding shaft at the time of winding the continuous roll of paper on the winding shaft. The detecting facilities presses the top paper of the stacked cut papers on the bottom plate and is provided with a paper press for pressing the outer periphery of the continuous roll of paper wound around the winding shaft wherein the paper press is movable up and down such that detecting facilities detects the rising of the paper press an issues a signal when the stacked cut papers reach a prescribed stacked height or when the winding diameter of the continuous roll of paper wound around the winding shaft reaches a prescribed value.

With such an arrangement of the press force control apparatus for a paper, it is possible to press both the cut papers to be stacked on the bottom plate and the continuous roll of paper by a single paper press. Further, the stacking and winding amount detecting facilities can detect that both the stack height and winding amount reach predetermined values.

Furthermore, the winding shaft of the press force control apparatus of the paper stacker includes a winding shaft body and a cylindrical winding sleeve having a slit in the axial direction thereof in which the winding sleeve is engageable with the winding shaft body.

With such an arrangement of the winding shaft, if the winding sleeve in engaged with the winding shaft body after the continuous roll of paper is wound around the winding shaft body, the continuous roll of paper can be surely fixed to the winding shaft by pressing the continuous roll of paper around the winding shaft body in the manner of wrapping around the winding shaft. The continuous roll of paper passes through the slit of the winding sleeve and comes out of the slit.

Still furthermore, the press force control apparatus for a paper stacker of the present invention which successively stacked cut papers therein by inserting a cut paper beneath the previous stacked papers is characterized in comprising a paper press for pressing the stacked cut papers from the top surface thereof and a press force switching facilities contacting the paper press for applying press force to the stacked cut papers until the stack height of the stacked papers reaches a predetermined value and for releasing the application of the press force when the stack height of the stacked papers exceeds the predetermined value.

With such an arrangement of the press force control apparatus for a paper stacker of the present invention, the press force is applied to the paper press until the stacked papers reach the predetermined stack height by the press force switching facilities. Accordingly, even if paper which is curled is fed into the bottom plate until the stack height reaches the predetermined value, the curled papers is pressed by the press force of the paper press toward the bottom plate, thereby restraining the paper from floating, which makes it possible to surely stack the curled paper.

On the other hand, if the stack height of the papers exceeds the predetermined height, the press force applies to the paper press is released. Accordingly, no excessive load is applied to the new paper to be inserted beneath the previously stacked papers. As a result, even if paper having perforations is to be inserted beneath the previously stacked papers, it can be inserted beneath the stacked papers and can be stacked to the predetermined height with assurance since a large resistance is not generated between the newly inserted paper and the stacked papers.

Still furthermore, the press force control apparatus for a paper stacker of the present invention having such a press force switching facilities is provided with a mechanism for adjusting the sack height of the cut stacked paper which is the basis of the press force switching facilities. With such an arrangement, the stack height for releasing the application of the press force can be selected so as to be optimum depending the kind of papers to be stacked.

The above and other object, feature, and advantages of the invention will be apparent from the following detailed description which is to be read in conjunction with the accompanying drawings.

DETAILED DESCRIPTION OF THE PREFERRED EMBODIMENT

Figure 1:
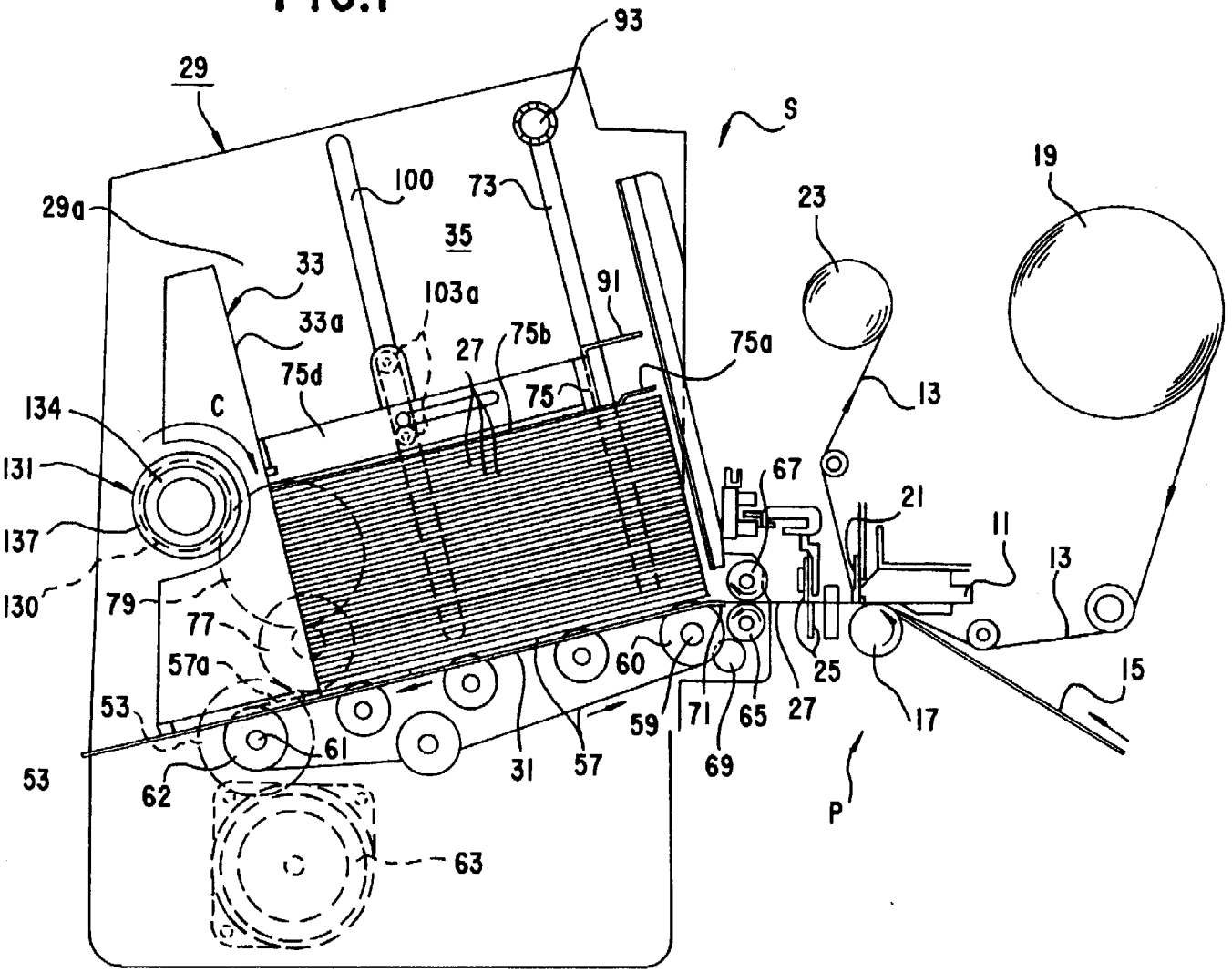
FIG. 1 is a side view of a schematic structure of press force control apparatus for a paper stacker of the present invention having a winding shaft, of one embodiment of the invention, attached to a printer in which the detailed structure is omitted.

FIG. 1 is a side view of a schematic structure in which a press force control apparatus for a paper stacker S of one embodiment of the present invention is installed in the primer P. A printer P to which the stacker S is attached is shown only partially according to the feature pertinent to the present invention.

More particularly, the printer P is provided with a thermal head 11 which prints onto a continuous roll of paper 15 while the continuous roll of paper 15 is pressed toward a platen 17 through a thermo-transfer ribbon 13. The continuous roll of paper 15 is rolled at a position, not shown, and is pulled out at the same position when the platen 17 is turned and then fed leftward in FIG. 1.

On the other hand, the thermo-transfer ribbon 13 is fed out of a feed ribbon 19 and taken up by a take-up bobbin 23 after is peeled off of the continuous roll of paper 15 by a peel-off plate 21 after printing. The printed continuous roll of paper 15 is cut by a cutter 25 at a predetermined length into a sheet of paper (hereinafter simply referred to as paper 27) which is then sent to stacker S.

Figure 2:
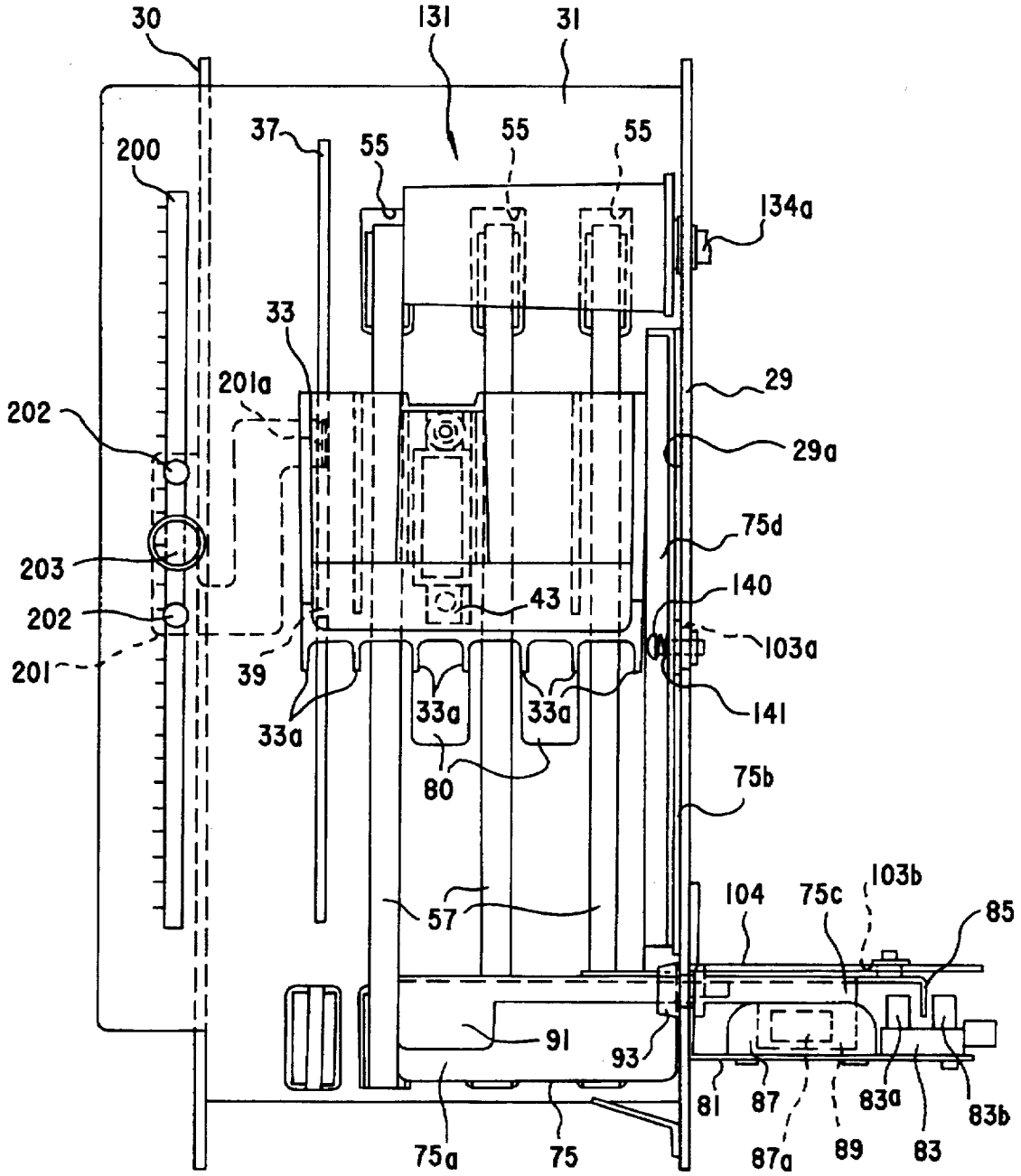
FIG. 2 is a plain view showing the press force control apparatus for a paper stacker.

The stacker S forms a paper receiver 35 having a bottom plate 31, a stopper 33 and plates 29 and 30 (both the side plates are hereinafter referred to as simply "side plate" and the front side plate 30 is not shown in FIG. 1) which are parallel to each other and have a predetermined interval therebetween, as shown in FIGS. 1 and 2. The bottom plate 31 is arranged in a manner so as to be transverse from the side plate 29 and gradually inclined with respect to direction in which the paper is being fed, as shown in FIG. 1.

The bottom plate 31 receives the cut papers 27. The side plate 29 has a paper restriction surface **29*a* which limits the back side end of each paper 27 as viewed from an operator who is positioned at the left side in FIG. 2, to be stacked on the bottom plate 31 (hereinafter referred to as back side end.) The stopper 33 limits the front end of each paper 27 to be stacked on the bottom plate 31 in the paper feed direction. One side plate 29 has a height higher than the maximum stack height of the papers 27 on the bottom plate 31. The other side plate 30 is provided only at the downstream side of the bottom plate 31 and has an open upper portion wherein the papers 27 stacked on the bottom plate 31 can be taken out from the from in FIG. 1 (and at the left side in FIG. 2**).

The stacker S is provided with a feed mechanism, described later, for feeding the paper 27 along the upper surface of the bottom plate 31 in the paper receiver 35. The papers 27 fed by the paper feed mechanism are successively stacked from the bottom by insertion beneath the lowest stacked paper 27 and the top ends of the papers 27 abut at the paper abut surfaces **33*a* of the stopper 33** in order to align the front ends thereof.

The stopper 33 is a molding product made by resins or the like. The paper abut surfaces **33*a* of the stopper 33 are formed by the from ends of a plurality of ribs extending upright from the upper surface of the bottom plate 31 and arranged in parallel with each other by leaving predetermined clearances therebetween in the width direction, as shown in FIGS. 2 to 4**.

Figure 3:
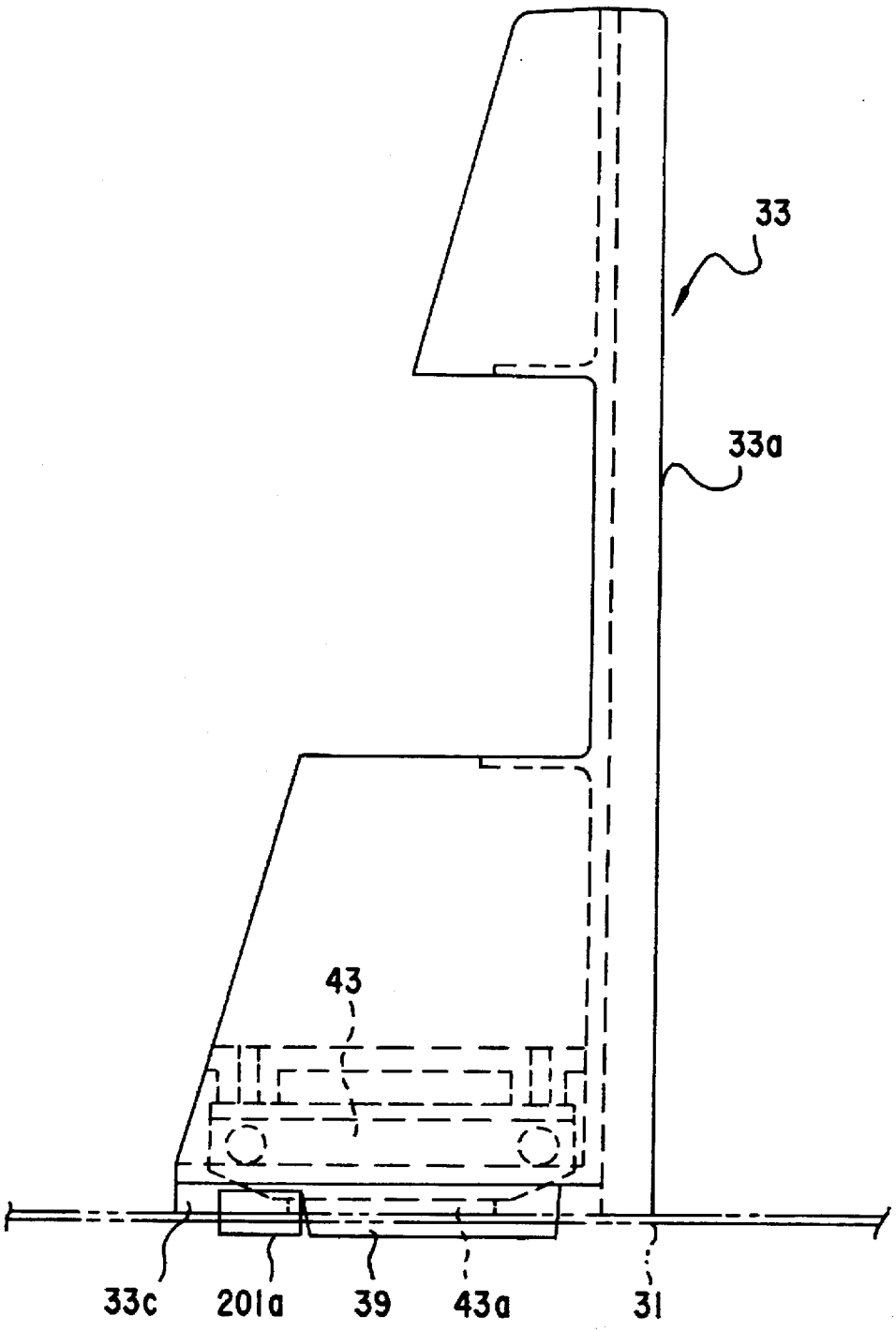
FIG. 3 is a side view showing a stopper 33 provided at the press force control apparatus for a paper stacker.
Figure 4:
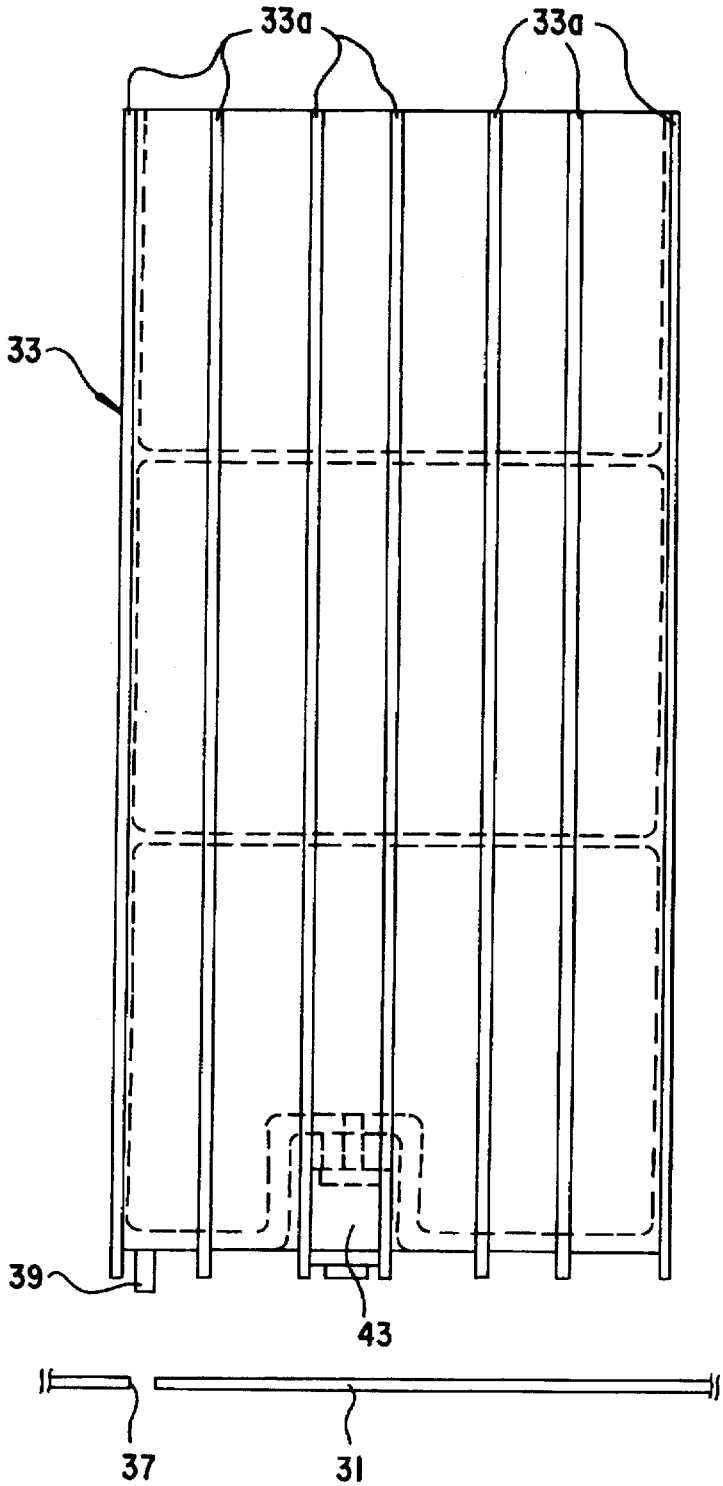
FIG. 4 is a front view of the stopper 33.

The bottom plate 31 is made of a strong magnetic material such as iron and has grooves 37 therein which are defined along the receiving direction of the papers 27 (as shown in FIGS. 2 and 4). The bottom of the stopper 33 is provided with a projection 39 which engages the groove 37 (FIGS. 3 and 4).

Further, a magnet 43 having a magnetic member **43*a* is fixed at the lower portion of the stopper 33, as shown by dotted lines in FIGS. 2 and 3**.

Another groove 200 is defined in the bottom plate 31 of the side plate 30 and the groove 200 is parallel to the groove 37. Pins 202, 202 are fixed or caulked on a positioning device 201 which is arranged under the bottom surface of the bottom plate 31. The pins 202, 202 are slidable within the groove 200. A knob 203 is fixed on the stopper positioning device 201 by a screw fashioned through the groove 200 from the upper surface of the bottom plate 31. By tightening the knob 203, the bottom plate 31 is held between the stopper positioning device 201 and the knob 203 so that the stopper positioning device 201 is fixed to the bottom plate 31.

The positioning device 201 extends inside the side plate 30 through a slit, not shown, which is defined between the side plate 30 and the bottom plate 31. A hook **201*a* is formed at the tip end of the positioning device 201 and it is bent upwardly and engages in the groove 37. The hook 201*a* projects from the upper surface of bottom plate 31 through the groove 37 as shown in FIG. 3** and abuts the projection 39 provided at the bottom surface of the stopper 33 and engages the groove 37.

Adhering force between the magnetic member 43*a* of the magnet 43 and the bottom plate 31 is determined in the manner that the stopper 33 can slide forward and backward along the groove 37 of the bottom plate 31 in the paper feed direction. Also, a scale is provided along one edge of the groove 200 to show the length of the paper in the paper feed direction or the size of the paper which can be stacked on the bottom plate 31.

Thus, the knob 203 is loosened to move with the positioning device 201 along the groove 200 and then the knob 203 is tightened, after aligning the center thereof with a certain position of the scale corresponding to the length of the papers to be stacked. With such an operation, the positioning device 201 can be fixed at a given position along the groove 200, while the hook 201*a* can be fixed at a given position along the groove 37.

Thereafter, the stopper 33 adheres to the bottom plate 31 and is moved along the paper feed direction while the projection 39 is engaged in the groove 37 and the stopper 33 is stopped when the projection 39 abuts the hook 201*a*. As a result, the positions of the paper abut surface 33*a* of the stopper 33 along both the paper feed direction and the direction transverse to the paper feed direction (hereinafter referred to as "width direction") are determined so that the stopper 33 can be positioned and fixed there. Thus, the feed depth of the paper receiver 35 can be adjusted at any length.

Further, if the upper side of the stopper 33 is turned so as to be inclined leftward around a rear lower end 33*c* of the stopper 33 as a fulcrum in FIG. 3, the stopper 33 can be easily detached from the bottom plate 31 by overcoming the adhering force between the magnet 43 ate 31 by overcoming the adhering force between the magnet 43 and the bottom plate 31.

The structure of the paper feed mechanism will be described hereinafter.

The bottom plate 31 has three elongated slits 55 along the paper receiving direction, as shown in FIG. 2. These slits 55 are porficed under the portion where feed belts 57 are positioned. The feed belts 57 are also provided along each of the slits 55. Each of the three feed belts 57 is entrained around each pulley 60 fixed on a common axis 59 and around each pulley 62 fixed on an axis 61 in such a manner that a feed surface 57*a* of each feed belt 57 slightly projects above the upper surface of the bottom plate 31 and is driven by a drive motor 63 along a counter-clockwise direction (in the direction of the arrow) as shown in FIG. 1.

Positioned immediately in front of each feed belt 57 are a roll-in roller 65 and a pinch roller 67 which hold the paper 27 fed out of the printer P and feed in into the paper receiver 35. The roll-in roller 65 is driven by an idle gear 69 which is driven by a gear, not shown, fixed on the pulley axis 59.

Moreover, a guide plate 71 is provided a the front edge of the bottom plate 31, as shown in FIG. 1 for smoothly receiving the paper 27 which is fed while being held between the roll-in roller 65 and the pinch roller 67.

According to this embodiment, the paper 27 fed out of the printer P is held between the roll-in roller 65 and the pinch roller 67 and is fed beneath the lowest paper of the papers stacked within the paper receiver 35. The paper 27 is fed by the feed belt 57 in such a manner that it slightly floats above the bottom plate 31 until it hits the paper abut surfaces 33*a*. Thus, the papers 27 fed out of the printer P are successively stacked from the bottom within the paper receiver 35 (i.e., the successively coming paper is stacked beneath the previously fed and stacked papers.

A winding shaft 131 for winding the continuous roll of paper which is not cut yet is provided at the side plate 29 as illustrated in FIG. 1. The winding shaft 131 projects substantially perpendicularly to a paper restriction surface 29*a* of the side plate 29. The winding shaft 131 includes a winding shaft body 134 to be turned by a driving system and a cylindrical winding sleeve 137 which engageable with the outer periphery of the winding shaft body 134 (refer to FIG. 16).

The winding shaft 131 receives the turning force of the driving motor 63, described later, from the winding gear 130 by way of a the pulley drive gear 53, the idle gear 77, the transmission gear 79 and the slip mechanism and is turned in the direction of the arrow C in FIG. 1.

Figure 5:
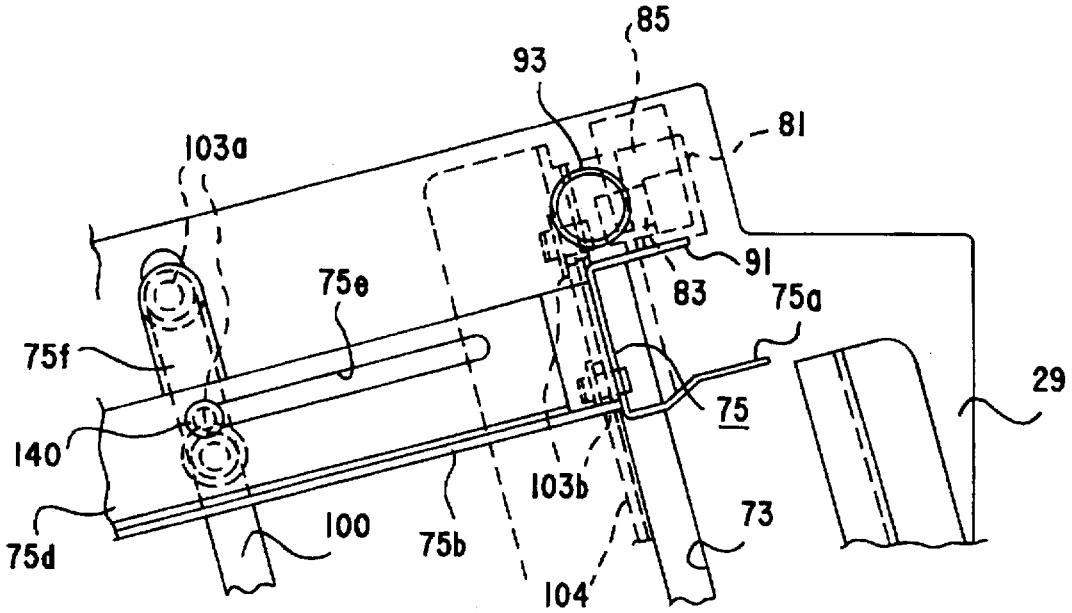
FIG. 5 is a side view showing a paper press 75 and a peripheral portion thereof provided at the press force control apparatus for a paper stacker.
Figure 6:
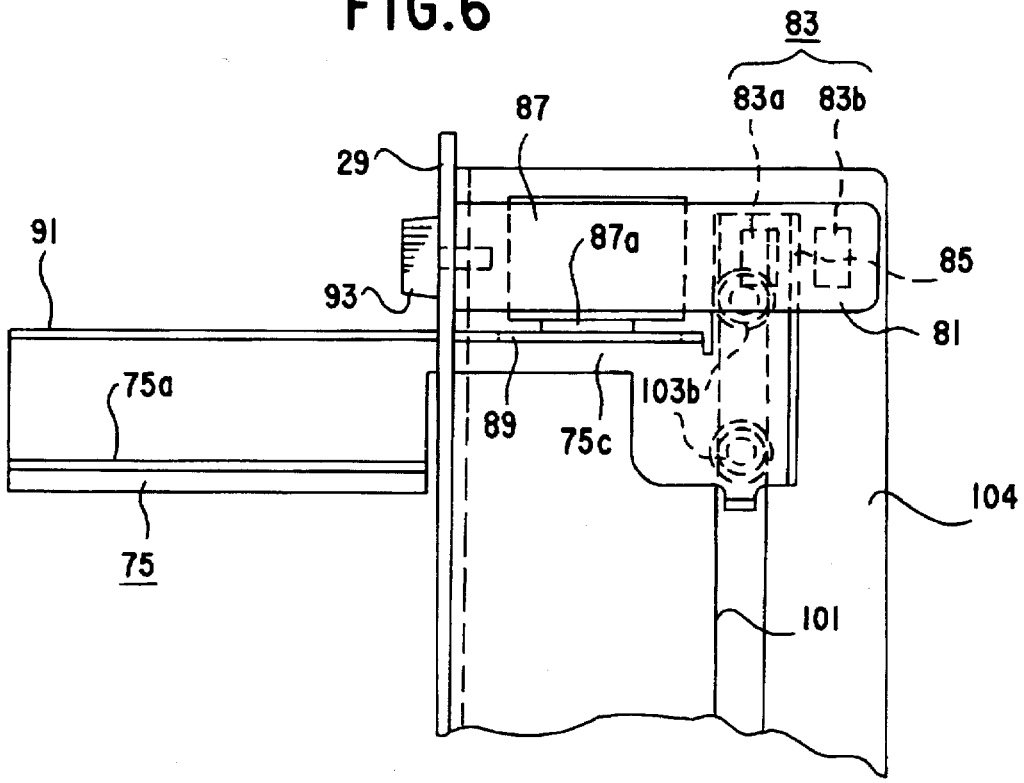
FIG. 6 is a front view of FIG. 5.

A paper press 75 provided at the stacker S is described with reference to FIGS. 1, 2 and 5 to 8. FIGS. 5 and 6 show the state where the height of the papers stacked on the bottom plate 31 of the stacker S reaches a predetermined height or value.

This stacker S is provided with the paper press 75 positioned slidably along up and down directions on the side plate 29. The paper press 75 presses the papers 27 stacked on the bottom plate 31 of the paper receiver 35 from the top portion along the paper feed direction and the direction transverse to the paper feed direction (paper width direction). The paper press 75 includes a main body portion 75*a*, an extension portion 75*b* having a L-shape in cross section and an arm piece 75*c* (FIG. 6) and a slide member 75*d*. The main body portion 75*a* extends in the direction transverse to the paper feed direction in the width direction. The side plate 29 is provided with a slit 73 which extends perpendicularly to the bottom plate 31 and the arm piece 75*c* projects outwardly through the slit 73 (FIG. 6). The slide member 75*d* is extendible leftward in FIG. 5 relative to an extension portion 75*b*.

Two ball bearings 103*a*, 103*a* are supported along the vertical direction with a certain distance therebetween. The distance is roughly about the center of the extension portion 75*b* of the paper press 75 and by a bearing holding portion 75*f* formed by extending a part of the extension portion 75*b* upward. The ball bearings 103*a*, 103*a* are rotatably engaged in a first guide groove 100 provided at the side plate 29 and extending in the direction perpendicular to the bottom plate 31.

Also, two ball bearings 103*b*, 103*b* are rotatably supported near the end of the arm piece 75*c* along a vertical direction with a certain distance therebetween, as shown in FIG. 6. On the other hand, a guide plate 104 is fixed to the side plate 29 at the outside thereof in the direction perpendicular to the side plate 29, and a second guide groove 101 is formed in the guide plate 104 in the direction perpendicular to the bottom plate 31 where two ball bearings 103*b*, 103*b* are rotatably engaged.

Thus, the paper press 75 smoothly moves in up and down directions by rotatable movement of the four ball bearings 103*a* and 103*b*. Therefor, a very small mount of resistance is generated between the guide grooves 100, 101 and the paper press 75 because of the rolling contact. Accordingly, when a continuous roll of paper is cut to form a paper 27 of a given length, the ends of the cut paper 27 may still be curled upwardly, the paper press 75 smoothly moves upward no matter where the extension portion 75*b* of the paper press 75 contacts the paper 27. Furthermore, even if the paper 27 having upwardly curled ends and large width is fed and contacts the main body portion 75*a* of the paper press 75 at a position distant from its support position, the paper press 75 always smoothly moves upward.

Figure 7:
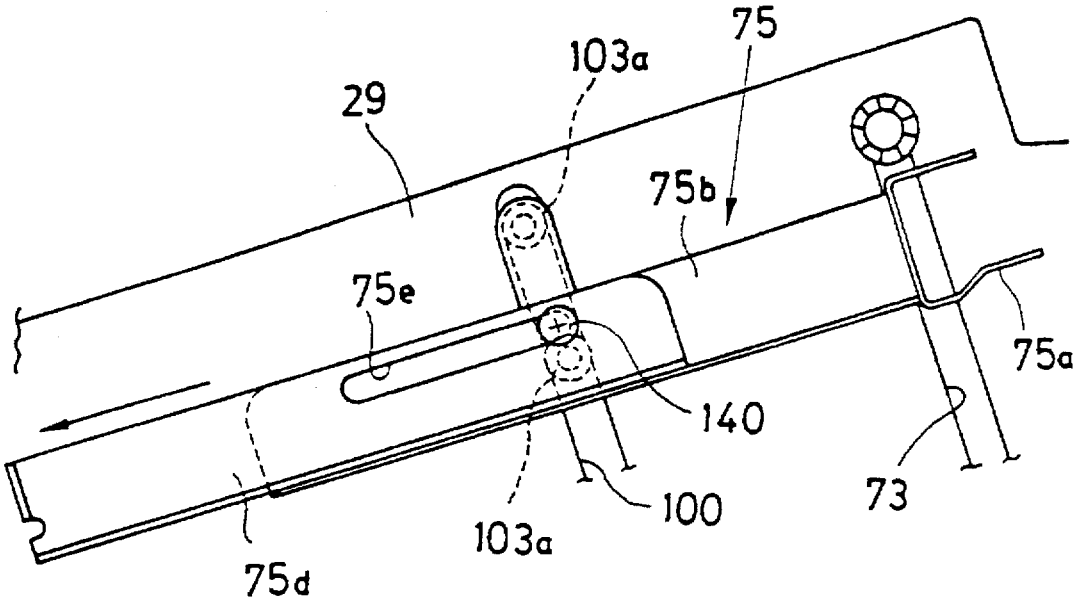
FIG. 7 is a side view showing the state where a slide member **75*d*** of the paper press is extended.
Figure 8:
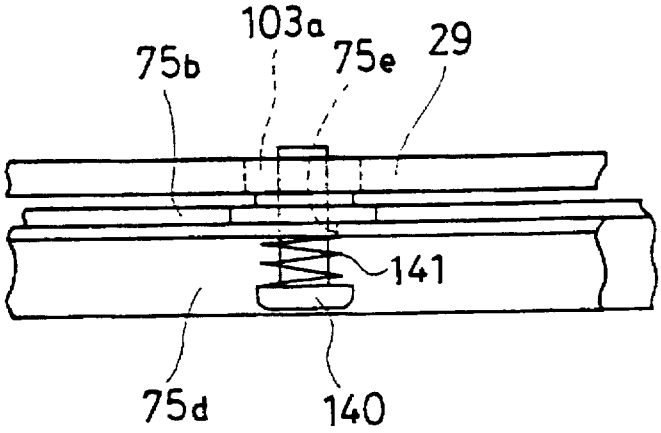
FIG. 8 is a plan view showing the attachment of the slide member **75*d*;**

The slide member 75b of the paper press 75 has an L-shape in cross section like the extension portion 75b and has substantially the same length in the paper feed direction as the extension portion 75b. The slide member 75d defines a long hole 75e extending from the substantially central portion to the right side and in the longitudinal direction as shown in FIG. 7. A screw 140 provided with a compression spring 141 is inserted into the long hole 75e as shown in FIG. 8 and it is fixed to the extension portion 75b by a fastening nut, not shown.

With such an arrangement, the slide member 75d is movable in the paper feed direction (sidewardly in FIG. 7) along the long hole 75e and the rear surface of the slide member 75d is brought into contact with the extension portion 75b of the paper press 75 by the urging force of the compression spring 141. Accordingly, the slide member 75d is prevented from moving arbitrarily by a vibration or similar which is generated when the paper 27 is stacked or the continuous roll of paper, described later, is wound around a winding shaft 131.

Figure 9:
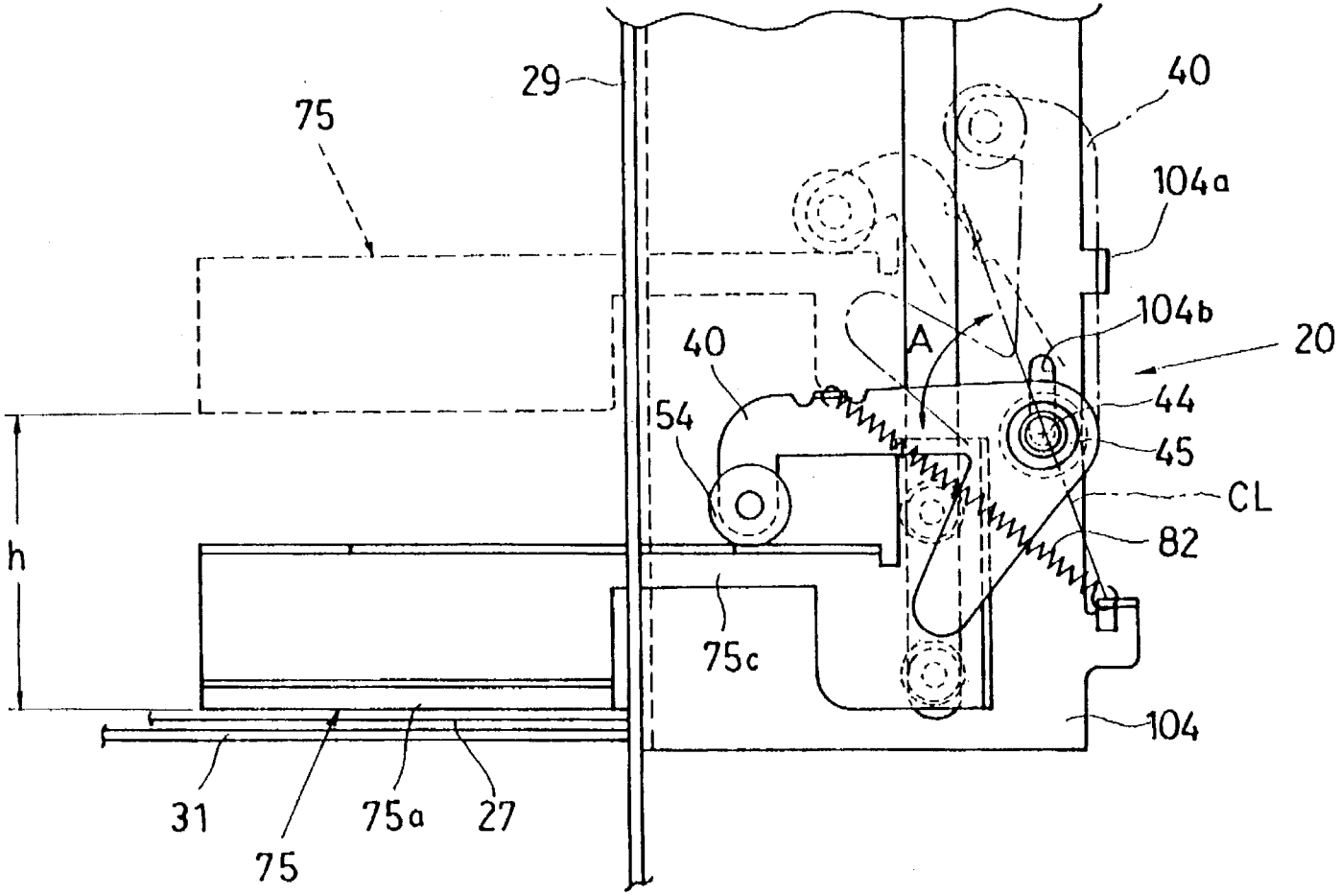
FIG. 9 is a front view for explaining a press force switching facilities 20 provided at the rear side of a back side plate 29 of the press force control apparatus for a paper stacker of FIG. 1.
Figure 10:
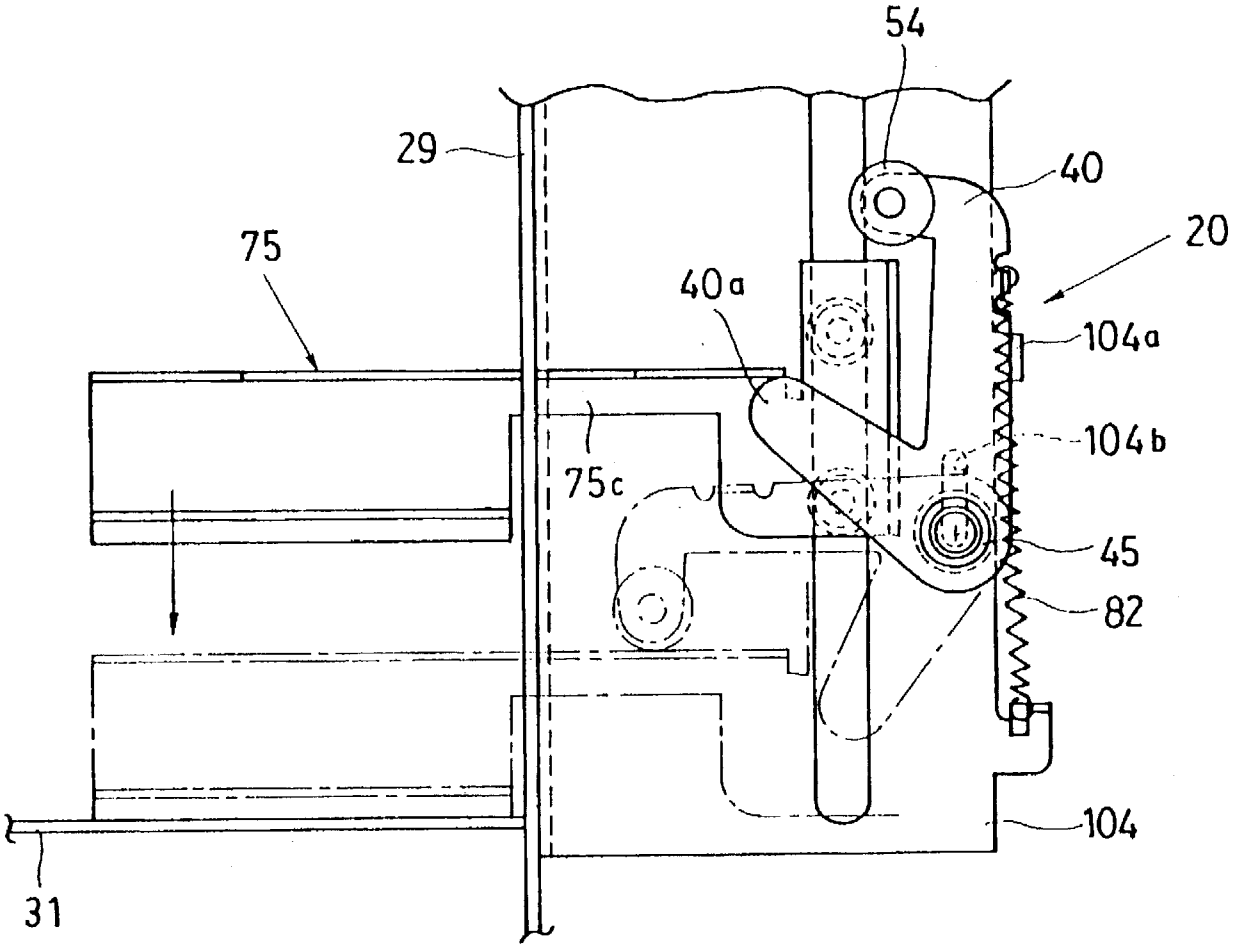
FIG. 10 is a front view showing the state where a lever 40 of the press force switching facilities 20 is turned to the position where it is movable by the rising of the paper press 75.

The slide member 75d is structured in such a manner that it may be turned about the screw 140 from a shunting position to an extended slide position as shown in FIG. 7. A press force switching facilities 20, which has a plate-like lever 40 formed in a substantially V-shape, is provided at the innermost side of the side plate 29 as shown in FIGS. 9 and 10. The press force switching facilities 20 contacts the upper surface of the arm piece 75c of the paper press 75 and applies the press force to the paper press 75 so that paper press 75 and applies the press force to the paper press 75 so that the paper press 75 presses the papers 27 exceeds the given height h, the press force switching facilities 20 functions to release the application of the press force.

The lever 40 of the press force switching facilities 20 rotatably supports a ball bearing 54 at its one end and the peripheral surface of the ball bearing 54 can contact the upper surface of the arm piece 75c of the paper press 75.

Figure 11:
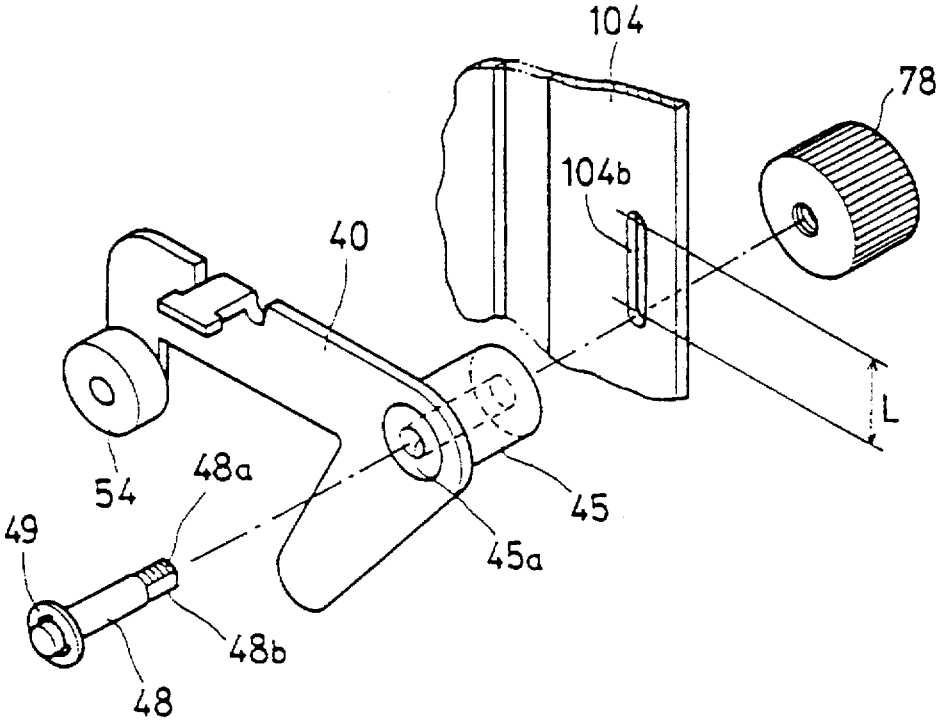
FIG. 11 is a exploded perspective view for explaining the structure of the supporting portion of the lever 40 of FIG. 10.
Figure 12:
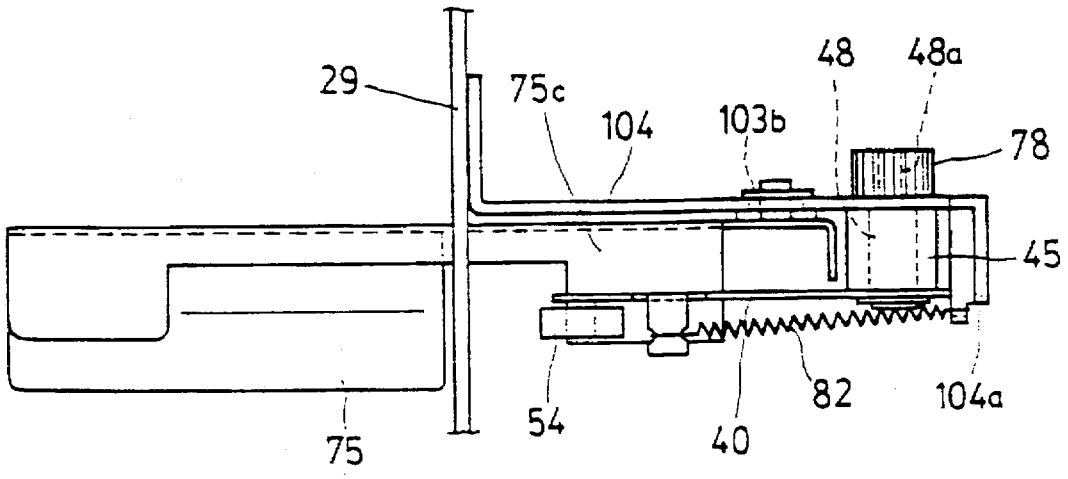
FIG. 12 is a plan view showing the press force switching facilities 20 of FIG. 9 and its vicinity.
Figure 13:
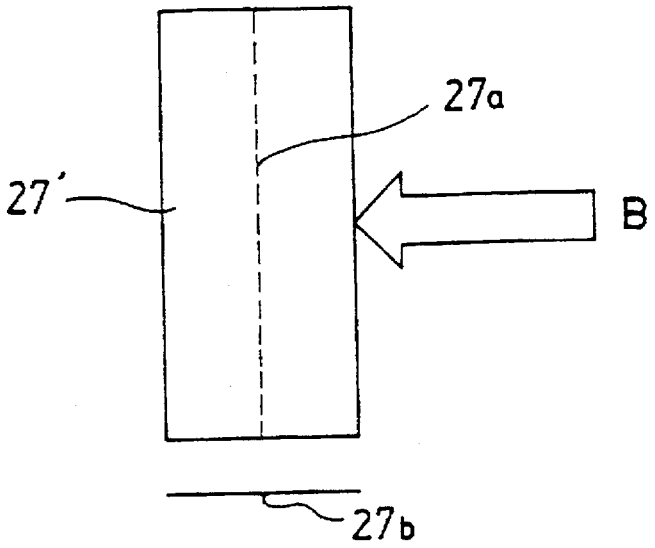
FIG. 13 is a plan view and a side view respectively showing a paper 27' having perforations thereon.

A fulcrum member 45 made of a shaft bearing material is integrally fixed to the substantially central portion of the lever 40. A through hole 45 is defined at the center of the fulcrum member 45 as shown in FIG. 11. A lever supporting shaft 48 having an E ring 49 at one end and a male screw 48a and parallel surfaces 48b, 48b at the other end (backside surface 48b does not appear in FIG. 11) is inserted from the side of the male screw 48a into the through hole 45a. The parallel surfaces 48b and 48b are inserted into a long hole guide groove 104b which is formed vertically at the guide plate 104 so as to be moveable in the up and down directions. A knob 78 is fixed to the male screw 48a which projects from the rear surface of the guide plate 104 of the lever supporting shaft 48. By this, the lever supporting shaft 48 is fixed to the guide plate 104 as shown in FIG. 12 and the lever 40 is rotatably supported by the lever supporting shaft in the direction of the arrow A in FIG. 9.

The knob 78 has such a size that it can be gripped and rotated at its diameter by fingers and the knob 78 is knurled at the peripheral surface thereof for preventing the fingers from slipping so as to be easily rotated.

With such an arrangement, if the knob 78 is loosened relative to the male screw 48a, the lever 40 can be moved along the long hole guide grooves 104b. Accordingly, if the lever 40 is loosened and then tightened again, the press force switching facilities 20 can be moved an fixed to an arbitrary position within the length L within which the press force switching facilities 20 is movable in up and down directions.

The lever 40 is turned about the fulcrum member 45 between a position where the peripheral surface of the ball bearing 54 contacts the upper surface of the arm piece 75c of the paper press 75 which is positioned at the lowest position as illustrated by a solid line in FIG. 9 and a position where the outer edge of the lever 40 contacts the stopper 104a as illustrated by a solid line in FIG. 10. There is retained a spring 82 for pulling and biasing the lever 40 between the lever 40 and the guide plate 104. Accordingly, at the time when the papers 27 begin to stack on the bottom plate 31, the lever 40 is positioned at the portion close to the position illustrated by the solid line in FIG. 9 so that the lever 40 is biased counter-clockwise by a tensile biasing force of the spring 82. As a result, a press force acts on the paper press 75 for pressing the papers 27 by a means of the ball beating 54. At the time when the papers 27 are less stacked on the bottom plate 31, the press force caused by the spring 82 is always applied to the paper press 75. The reason why the ball bearing 54 is interposed between the lever 40 and the paper press 75 is that the biasing force of the spring 82 is effectively transmitted to the paper press 75 while the friction between the lever 40 and the paper press 75 is reduced as much as possible.

In such a manner, the papers to be stacked on the bottom plate 31 are pressed by the main body portion 75a of the paper press 75 in the width direction (sidewardly in FIG. 9), while they are pressed by the extension portion 75b at the paper feed direction (sidewardly in FIG. 5) so that the paper 27 can be sacked on the bottom plate 31 in the normal state, even if the ends of the paper 27 are curled.

The paper press 75 is pushed upward as the stack height of the papers 27 rises when the papers 27 are successively stacked on the bottom plate 31. Accordingly, the ball bearing 54 contacting the upper surface of the arm piece 75c of the paper press 75 is also pushed upward. As a result, the lever 40 is pushed upward at one end thereof so that it is turned gradually clockwise in FIG. 9.

In such a manner, the lever 40 is turned clockwise as the amount of stacking of the papers 27 increases. When the center line CL of the spring 82 exceeds the turning center of the lever 40, i.e., the center of the fulcrum member 45 (positioned at the right side in FIG. 9), then tensile biasing force of the spring 82 acts on the lever 40 so as to turn the lever 40 clockwise. As a result, the lever 40 is turned clockwise this time by the tensile biasing force of the spring 82 regardless of the stack height of the papers 27 on the bottom plate 31. The lever 40 is turned until it reaches the portion where the end edge of the lever 40 contacts the stopper 104a as illustrated by the solid line in FIG. 10.

Thereafter, the ball bearing 54 of the lever 40 is moved away from the arm piece 75c of the paper press 75. Accordingly, the weight of the paper press 75 alone is applied to the papers 27 on the bottom plate 31.

In such a manner, the press force for pressing the papers 27 by the biasing force of the spring 82, i.e., for serving as a part of the wight, acts on the papers 27 only while the paper press 75 is raised from the position where the papers 27 begin to stack, as illustrated by the solid line in FIG. 9, to the stack height h (the height when the center line CL of the spring 82 conforms to the center of the fulcrum member 45 serving as the turning center of the lever 40). Thereafter, only the weight of the papers 27 stacked on the bottom plate 31 and the wight of the paper press 75 are applied to the paper which is positioned at the lowest of the papers 27 stacked on the bottom plate 31. In this case, even if the curly paper is inserted beneath the lowest stack paper as illustrated in FIG. 1, the same paper can be sufficiently stacked in a norman state due to the weight of the stacked papers 27 and the weight of the paper press 75 because there are stacked papers 27 on the bottom plate 31 to some extent h.

In a case where the sizes of the papers 27 to be stacked on the bottom plate 31 are varied, the lever 40 can be adjusted in the up and down directions (in the stack height direction of the paper as illustrated in FIG. 11. Accordingly, it possible to vary the limit of height until which the biasing force of the spring 82 is applied to the paper press 75 (the height h in FIG. 9) by varying the position of the lever 40 depending on the sizes of the papers to be used to that the papers 27 can be stacked under the optimum conditions.

When all the papers 27 are taken out from the bottom plate 31 upon completion of the stacking of the papers 27 on the bottom plate 31 (when the adhering piece 89 adheres to the magnetic member 87*a*, the adherence of the adhering member 84 to the magnetic member 87*a* is released as illustrated in FIG. 6, described later), the paper press 75 is lowered by its own weight until it reaches the position as illustrated by the solid line in FIG. 10. The end lower surface of the arm piece 75*c* contacts the end of 40*a* of the lever 40 to which the ball bearing 54 is not attached and the paper press 75 stops at the same position.

If the paper press 75 is pressed downwardly, the end 40*a* of the lever 40 is likewise pushed downward so that the lever 40 is turned counter-clockwise against the biasing force of the spring 82. As a result, the lever 40 is returned to the position where the paper 27 begins to stack, as illustrated by an imaginary line in FIG. 10, while the peripheral surface of the ball bearing 54 at the other end of the lever 40 again contacts the upper surface of the arm piece 75*c* by the biasing force of the spring 82.

Figure 14:
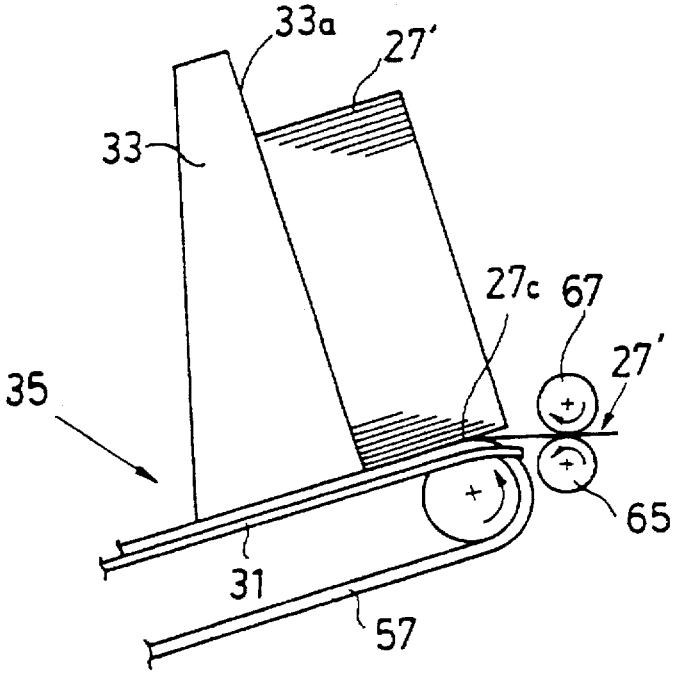
FIG. 14 is a schematic enlarged view for explaining the stack fail state at the time when the paper 27' having the perforations is inserted beneath the previously stacked papers.

Meanwhile, there is a paper 27' of the papers 27 to be printed by the Printer P (FIG. 1), which has perforation 27*a* in the direction (paper width direction) transverse to the paper feed direction (arrow B). If this kind of paper 27' is stacked in the stacked S as illustrated in FIG. 1, a new paper 27' is held and fed by the roll-in roller 65 and the pinch roller 67 and inserted beneath the lowest paper 27' of the stacked papers' on the bottom plate 31 of the paper receiver 35 (precisely on the feed belt 57) as illustrated in FIG. 14. The newly inserted paper 27' is inserted beneath the lowest stacked paper 27' while slidably contacting the lowest stacked paper 27'.

Figure 15:
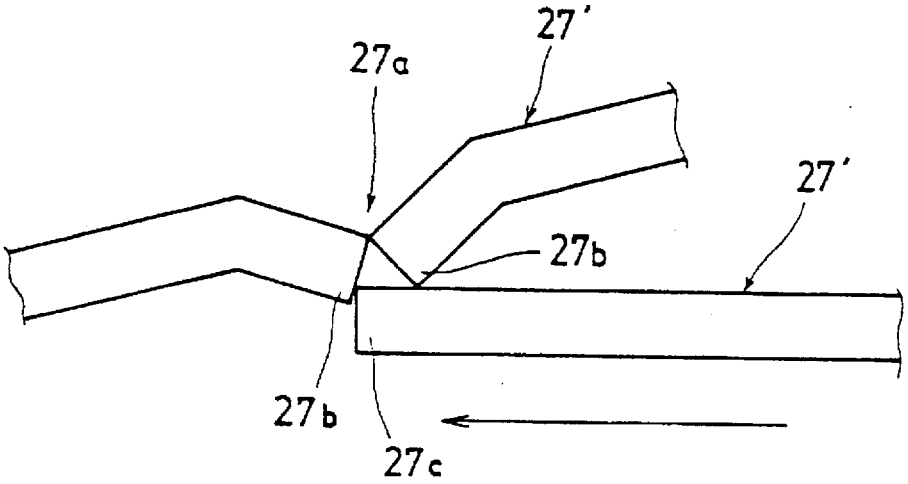
FIG. 15 is a schematic enlarged view showing the sate where the paper 27' having the perforations hits a flash **27*b*** of the previously stacked papers.

If there are perforations 27*a* in the paper, there is a possibility that a flash 27*b* is formed on the paper at the formation of the perforation 27*a* as illustrated in FIG. 15. If the flash 27*b* is formed on the back side of the paper 27' as illustrated in FIG. 15, the following problems occur. That is, since the top end 27*c* of the newly inserted papers 27' hits the flash 27*b* of the lowest stacked paper 27', there is a possibility that the newly inserted paper 27' cannot be further inserted even if further insertion of the newly inserted paper 27' is attempted.

The resistance of the newly inserted paper 27' caused by the contact with the flash 27*b* is greater as the stack height of the paper 27' is increased. The resistance is also increased as the resistance of the paper press 75 at the rising time (friction resistance between the papers 17') and the weight applied to the paper press 73 reaches a given height) are increased.

However, the friction between the feed belt 57 and the paper 27' cannot be obtained unless the press force of the paper press 75 acts to some extent on the paper 27' on the bottom plate 31 so that the paper 27' cannot be fed on the bottom plate 31. To obtain such friction, it is ideal that the press force (using weight, etc.) necessary to feed the paper 27' by means of the feed belt 57 acts on the paper press 75 during the stacking of the paper 17' on the bottom plate 31 from zero stacked papers to a predetermined number of stacked papers until a predetermined height is reached and the same press force may be lightened when the paper 17' exceeds the predetermined height.

According to the stacker of this embodiment, the biasing force by the spring 82 is applied to the paper press 75 as the press force (function of a weight) from the time when the paper 27 begins to stack on the bottom plate 31 until it reaches the stack height h. Thereafter, only the width of the stacked papers 27 and weight of the paper press 75 are applied to the lowest stacked paper 27 on the bottom plate 31.

Accordingly, even in the case where paper 27' having perforations are stacked as illustrated in FIG. 15, since the press force to be applied to the top paper of the stacked papers 17' is small, the resistance of newly inserted paper 27', which is generated when the top end of the newly inserted paper 27' hits the flash 27*b* formed at the back side of the perforation 27*a* of the stacked papers 27', is small. Therefore, the newly inserted paper 27' gets over the flash 27*b* and is fed smoothly leftward in FIG. 14 and is stacked at a given position.

A stack full sensor 83 which is provided in the stacker will be described.

A bracket 81 is attached to and supported by the side plate 29 (FIG. 5) at the upper outside of the slit 73 (innermost part in FIG. 5) by a set screw 93 as illustrated in FIGS. 2 and 6. The stacker full sensor 83 such as a photo-interrupter is attached to the bracket 81 and includes a light emitter 83*a* and a light receiver 83*b* which confront each other.

The paper press 75 has shutter 85 which is formed by bending the tip end of a portion of the arm piece 75*c* at a right angle to extend to the outside from the side plate 29. As the number of stacked papers 27 increase, the paper press 75 is raised. When the stack height reaches the prescribed stack height, the shutter 85 eventually moves into the space between the light emitter 83*a* and the light receiver 83*b* of the stack full sensor 83. At this time, the stack full sensor 83 detects the rising of the paper press 75 and issues a stack full signal to the printer P in order to stop the printing operation. The same signal is also supplied to the drive motor 63 (FIG. 1) so that the drive motor 63 is stopped within a given time lag from the stoppage of the printer P, thereby stopping the stacking operation of the papers 27.

The bracket 81 is movable in up and down directions along the slit 73 and can be fixed at an arbitrary position by the set screw 93. The set screw 93 is of a size to be turned by fingers and is knurled at the outer peripheral surface thereof so that it has good operability. The stack full detected height can be freely adjusted at any position by arbitrarily varying the height of the stack full sensor 83 attached to the bracket 81.

The magnet 87 having a magnet member 87*a* is fixed to the bracket 81 as illustrated in FIG. 6. An adhering piece 89, which adheres the magnet member 87*a* is provided at the arm piece 75*c* of the paper press 75. If the paper press 75 is made of a magnetic metal plate such as an iron plate, etc., the adhering piece 89 can be integrated with the arm piece 75*c*. However, if it is done otherwise, the adhering piece 89 made of the magnetic metal may be attached to the arm piece 75*c*.

A finger hook (or knob) 91, having a shape to be raised by fingers, is integrally provided at the upper portion above the main body portion 75*a* of the paper press 75. The finger hood 91 or the knob formed by a separate member may be attached to the paper press 75. With such a structure, the paper press 75 is raised by pulling the finger hook 91 with a finger, while adhering piece 89 adheres to the magnet member 87*a* of the magnet 87 when a bundle of papers 27 stacked on the bottom plate 31 of the paper receiver 35 is taken out. The paper press 75 will not fall downward even if the finger is released. The papers 27 can be more easily taken out if the adhering piece 89 of the paper press 75 is set so as not to adhere to the magnet member 87*a* of the magnet 87 when the stack full sensor 83 detects the full stack of the papers. In other words, if the adhering piece 89 is set to adhere to the magnet member 87*a* of the magnet 87 provided that the shutter 85 is formed long in vertical direction and the paper press 75 is further raised after the stack full sensor 83 detected the full stack of papers 27.

A winding shaft 131 includes a winding shaft body 134 and a winding sleeve 137 which is engaged with the winding shaft body 134. The winding shaft body 134 has a shaft 134*a* fixed thereto at the center thereof which is rotatably supported by the side plate 29 by bracket 132 (FIG. 17). The winding sleeve 137 in engaged with the outer periphery of the winding shaft body 134 (projecting forwardly in FIG. 16) at the time of winding of the continuous roll of paper 15. The winding sleeve 137 is cylindrical and is made of synthetic resins. The winding sleeve 137 has a slit 137*b* in the axial direction thereof and a collar 137*a* at one end thereof. If the winding shaft body 134 is tapered in the manner that the tip end portion thereof is slightly smaller than the root thereof, the winding sleeve 137 can be smoothly engaged with the winding shaft body 134.

A turning force from the drive motor 63 is transmitted to the shaft 134*a* of the winding shaft 131 by a driving force transmission mechanism composed of a combination of a plurality of gears and a slip mechanism 2 as illustrated in FIG. 17. The shaft 134*a* is turned by this turning force in the direction to wind the continuous roll of paper (in the direction as denoted of the arrow C in FIG. 16).

The driving force transmission mechanism 1 includes a drive gear 41 fixed to the rotary shaft of the drive motor 63, a pulley drive gear 53 meshing the drive gear 41, and idle gear 77 meshing the pulley drive gear 53 at the large diameter portion and meshing the transmission gear 79 at the small diameter portion, a slip gear 133 to which the turning force of the transmission gear 79 is transmitted and a winding gear 130 which is integrated with the shaft 134*a* that meshes the slip gear 133.

As illustrated in FIG. 17, a friction member 80 made of felt or similar is attached to the left end surface of the transmission gear 79 which is rotatably supported by the shaft 135. The right end surface of the slip gear 133 contacts the friction member 80. The left end surface of the slip gear 133 contacts a press plate 136 which is rotatably engaged in the cylindrical portion 79*a* of the transmission gear 70 by the friction member 80. A male portion is formed on the outer peripheral surface of the cylindrical portion 79*a* of the transmission gear 79 at the tip end portion thereof and a spring receiver 138 is threaded in the male portion. A compression spring 139 is interposed between the spring receiver 138 and the press plate 136. The slip gear 133 is firmly held between two friction members 80 when the press plate 136 having the same diameter as the slip gear 133 is pressed and biased against the slip gear 133 and the friction members 80 when the slip gear 133 is turned.

With such a structure of the slip mechanism 2, when the transmission torque between the transmission gear 79 and the slip gear 133 exceeds a predetermined value, there is generated a slip between the transmission gear 79 and the slip gear 133 by the friction members 80 so that the turning force from the transmission gear 79 is not transmitted to the slip gear 133.

According to the driving force transmission mechanism 1 having the slip mechanism 2, the turning force from the drive motor 63 is sequentially transmitted to the transmission gear 79 and the turning force from the transmission gear is transmitted to the slip gear 133 using the friction between the slip gear 133 and the friction members 80. The turning force from the slip gear 133 is transmitted to the winding shaft 131 by the winding gear 130 so that the winding sleeve 137 of the winding shaft 131 is turned in the direction of the arrow C to thereby wind the continuous roll of paper 15.

With the above-described arrangement of the driving force transmission mechanism 1, if the winding speed by the rotation of the winding shaft 131 is set to be the same as or greater than the paper feeding speed of the printer P, the difference between the winding speed, which is accelerated by the increase of the paper winding diameter D, and the paper discharging speed at the printer side, can be absorbed by the slip mechanism 2 (FIG. 17). Accordingly the continuous roll of paper 15 is always wound around the winding sleeve 137 at the speed conforming to the paper discharging speed.

The continuous roll of paper 15 is prevented from slackening since a given tension is always applied to the continuous roll of paper 15 which is discharged from the printer P because of the slip caused by the difference between the winding speed and the paper discharging speed as mentioned above.

As is evident from FIG. 17, the pulley gear 53, to which the turning force from the drive motor 63 is transmitted, drives a feed facilities for stacking the cut paper, as explained with reference to FIG. 1. That is, three pulleys 62 are fixed at given intervals to the shaft 61, which is fixed at one end thereof to the pulleys 62 for feeding the cut sheets.

Figure 19:
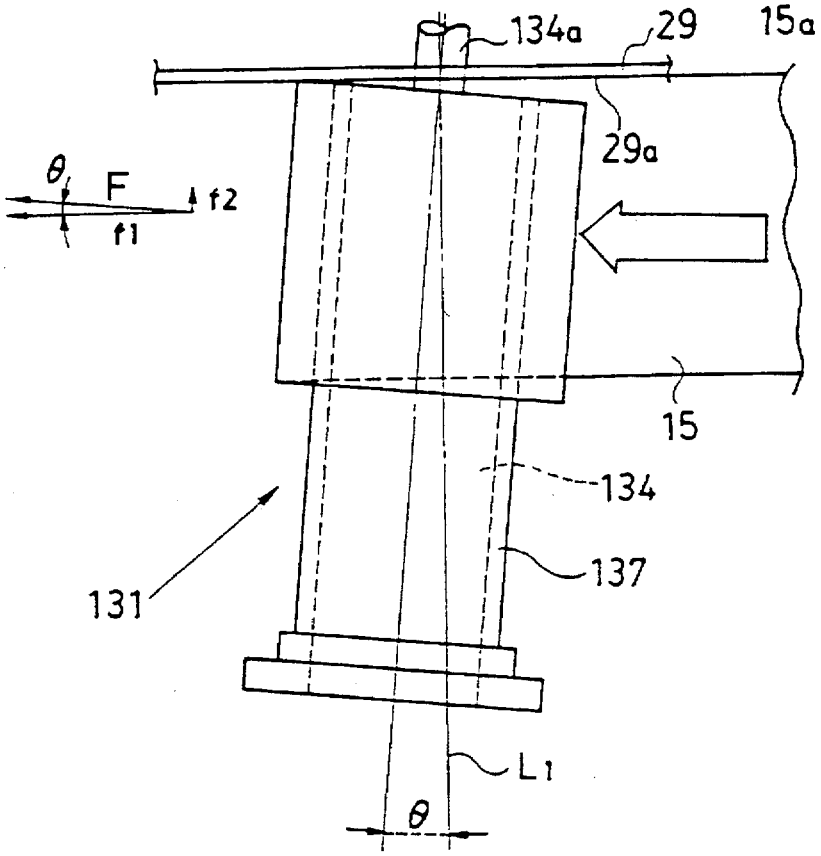
FIG. 19 is a plan view for explaining an attaching angle of the winding shaft 131 relative to the side plate 29.

The winding shaft 131 is rotatably supported by the side plate 29 so as to be inclined at an angle 0 relative to the line L1 transverse to the paper feeding direction as illustrated in FIG. 19.

Since the winding shaft 131 is inclined at the angle θ, a paper winding force F acts on the continuous roll of paper 15 to be wound by the winding shaft 131 in the direction inclined by the angle θ relative to the paper restriction surface 29*a*. The component of the paper winding force F includes a paper tensile force f1 which acts in parallel with the paper restriction surface 29*a* and a paper press component force f2 which acts perpendicularly to the paper restriction surface 29*a*.

Accordingly, the continuous roll of paper 15 is wound around the winding sleeve 137 by the paper tensile force f1, while the innermost end surface 15*a* of the continuous roll of paper 15 is pressed against the paper restriction surface 29*a* of the side plate 29 by the paper press component f2. As a result, the paper can be wound neatly, while the innermost end of surfaces 15*a* of the continuous roll of paper 15 are aligned.

Since the force for holding the winding sleeve 37 of the winding shaft body 134 is set to be greater than the paper press component force f2, the position where the winding sleeve 137 is attached to the winding shaft body 134 does not slip out downwardly in FIG. 19 or the winding sleeve 137 does not come out from the winding shaft body 134, even if reaction of the paper press component force f2 acts on the winding sleeve 137.

Accordingly, the continuous roll of paper 15 can be wound around the winding sleeve 137 with assurance, while the innermost end surface 15*a* of the continuous roll of paper 15 is restricted in position so as to be aligned along the paper restriction surface 29*a* of the side plate 29.

The continuous roll of paper 115 is wound in the following procedures according to eh press force control apparatus for a paper stacker of this embodiment.

First, the paper press 75 is raised as illustrated in FIGS. 5 and 6, while the adhering piece 89 adheres to the magnet member 87*a* of the magnet 87 and then, the paper press 75 is fixed at the upper portion in the paper receiver 35. Next, the slide member 75*d* provided at the extension portion 75*b* of the paper press 75 is extended in the paper feed direction as illustrated in FIG. 7.

Figure 16:
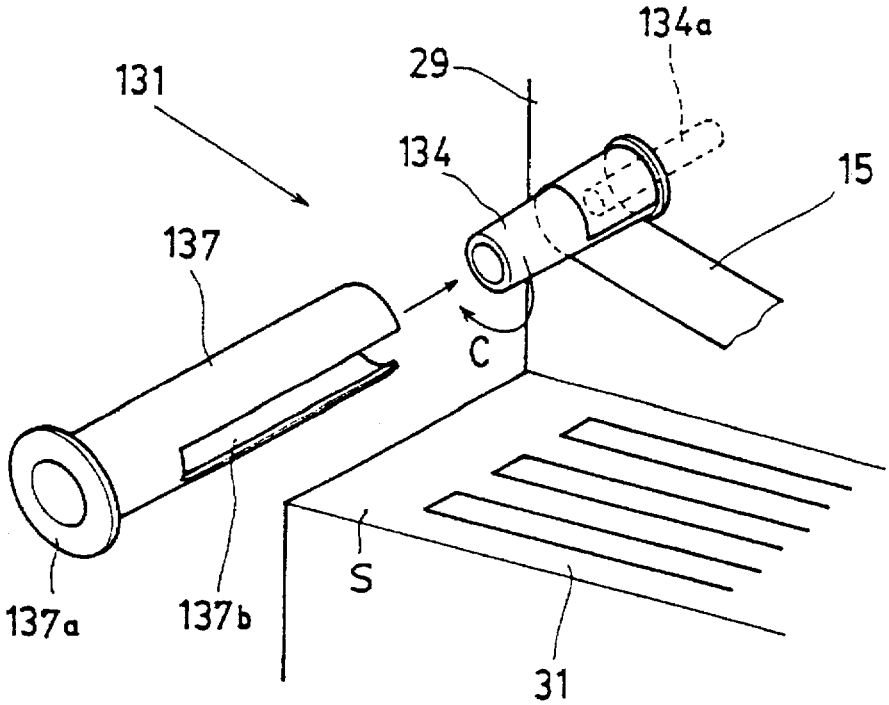
FIG. 16 is a perspective view for explaining the structure of a winding shaft 131 provided in the press force control apparatus for a paper stacker of FIG. 1.
Figure 17:
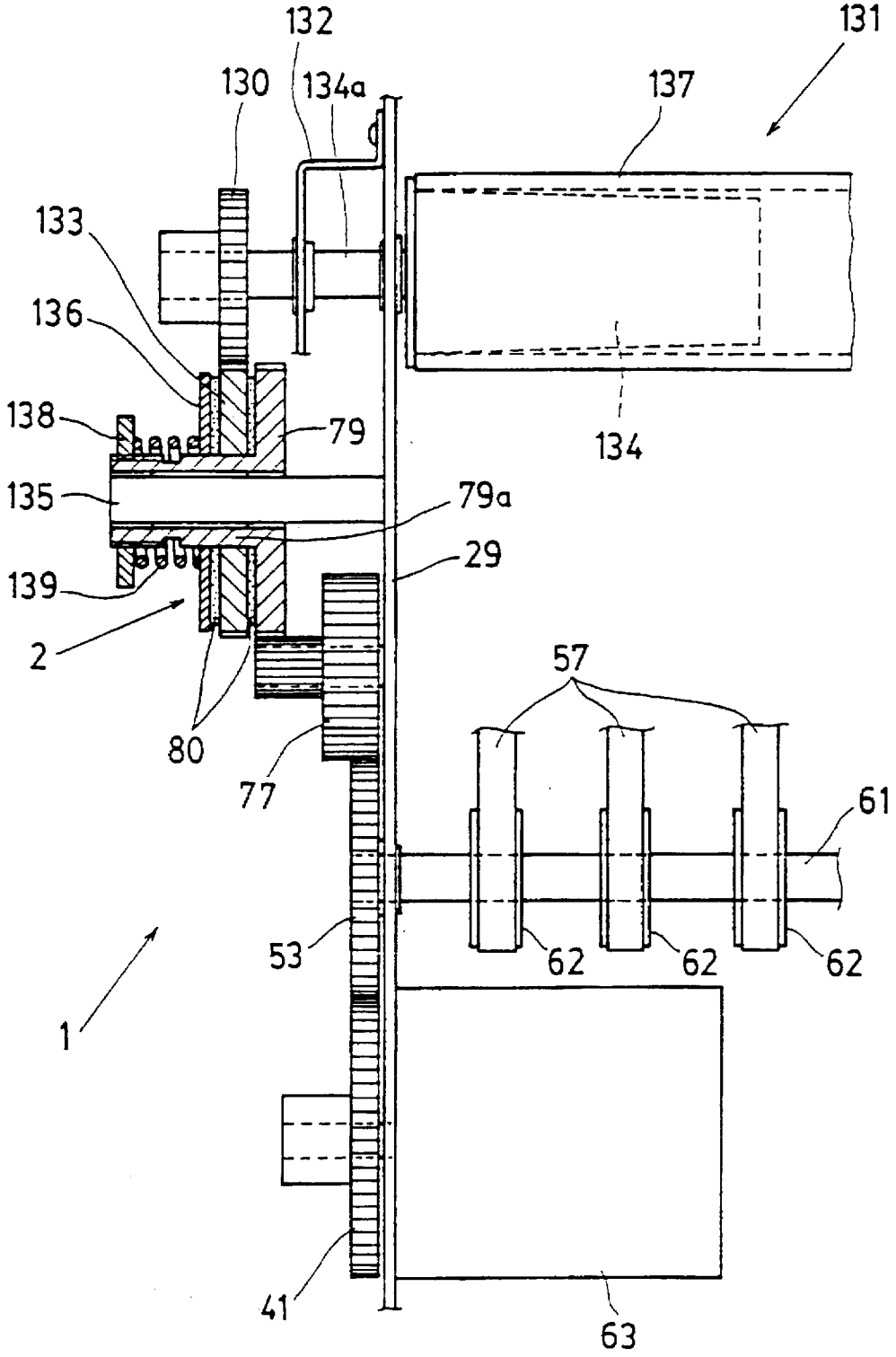
FIG. 17 is a plan view showing a driving force transmission mechanism 1 for driving the winding shaft 131.
Figure 18:
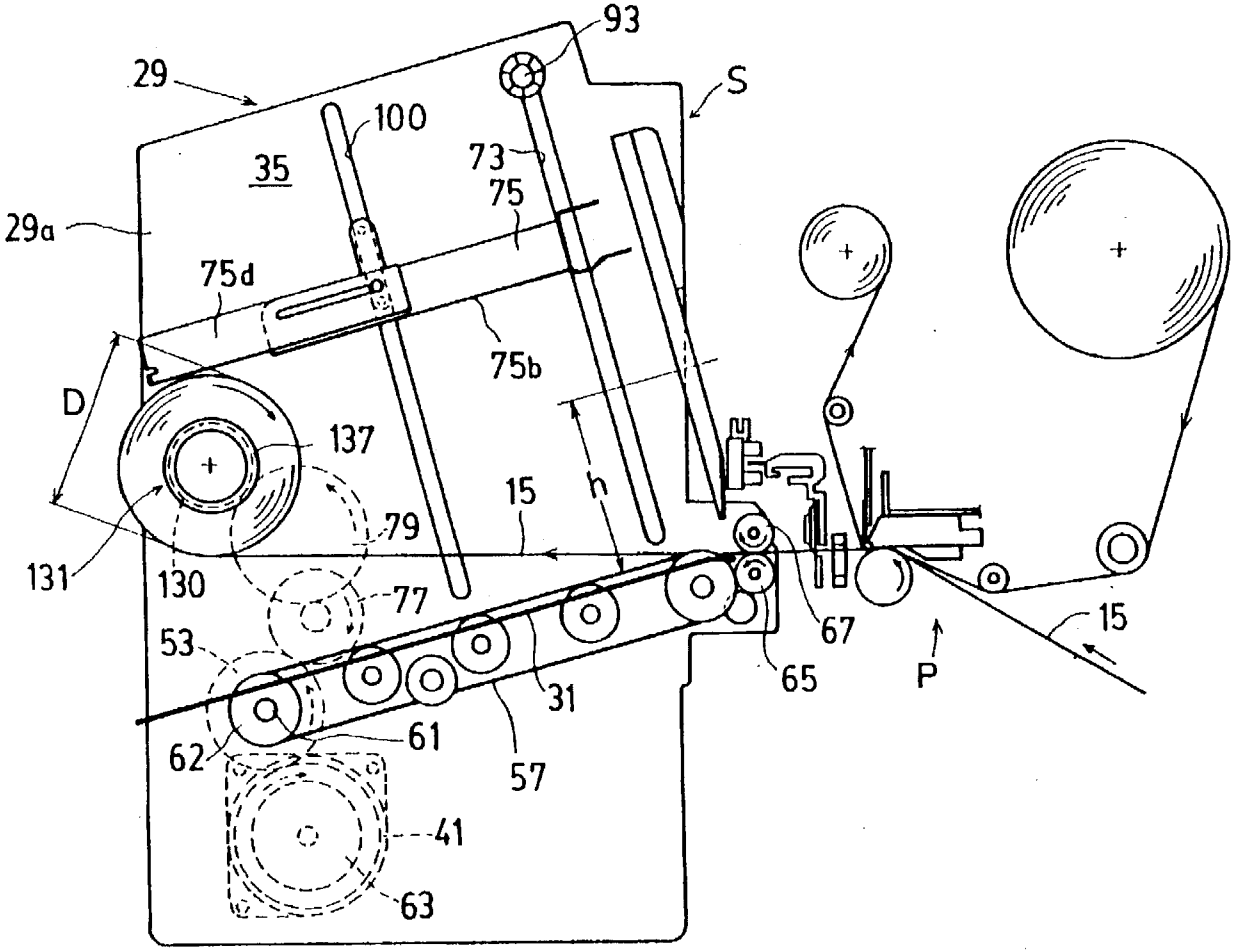
FIG. 18 is a schematic view showing the state where a continuous roll of paper 15 is wound by the press force control apparatus for a paper stacker of FIG. 1.

After the continuous roll of paper 15 is wound clockwise by one winding around the winding shaft body 134 at the tip end portion as illustrated in FIG. 16, the winding sleeve 137 is engaged with the winding shaft body 134, whereby the top end portion of the continuous roll paper 15 is held between and fixed to the winding shaft body 134 and winding sleeve 137. The continuous roll of paper 15 is pulled out from the slit 137*b* of the winding sleeve 137.

Thereafter, the adherence of the adhering piece 89 to the magnet member 87*a* of the magnet 87 as illustrated in FIGS. 5 and 6 is released. In other words, the adhering piece 89 is released from the magnet member 87*a* to thereby lower the paper press 75 so that the slide member 75*d* is brought into contact with the outer periphery of the continuous roll of paper 15, whereby the printing and winding operations start thereafter.

At the beginning of winding of the continuous roll of paper 15, since the paper press 75 is positioned higher than the position (height h) where the spring 82 can apply the press force to the paper press 75 as illustrated in FIG. 9, the weight of the paper press 75 alone acts on the outer periphery of the continuous roll of paper 15. The lower surface of the slide member 75*d* of the paper press 75 contacts the outer peripheral upper end of the continuous roll of paper 15 which is wound around the winding sleeve 137. The position of the outer peripheral surface of the continuous roll of paper 15 rises as the winding diameter of the continuous roll of paper 15 is increased.

When the detecting portion of the stack full sensor 83 reaches the height where it is shaded by the shutter 85 formed at the end of the paper press 75 (also refer to FIG. 2), the stack full signal (winding full signal) is issued by the stack full sensor 83 in the same way as in the case of the cut paper, whereby the drive motor 63 is stopped so as to stop the winding operation of the continuous roll of paper 15.

The stack full sensor 83 is freely movable in up and down directions along the slit 73 as illustrated in FIG. 5 by loosening the set screw 93. Accordingly, it is possible to arbitrarily set the stopping time of the paper winding operation depending on the amount of winding of the continuous roll of paper 15 by moving and fixing the stack full sensor 83 to an arbitrary position.

Figure 20:
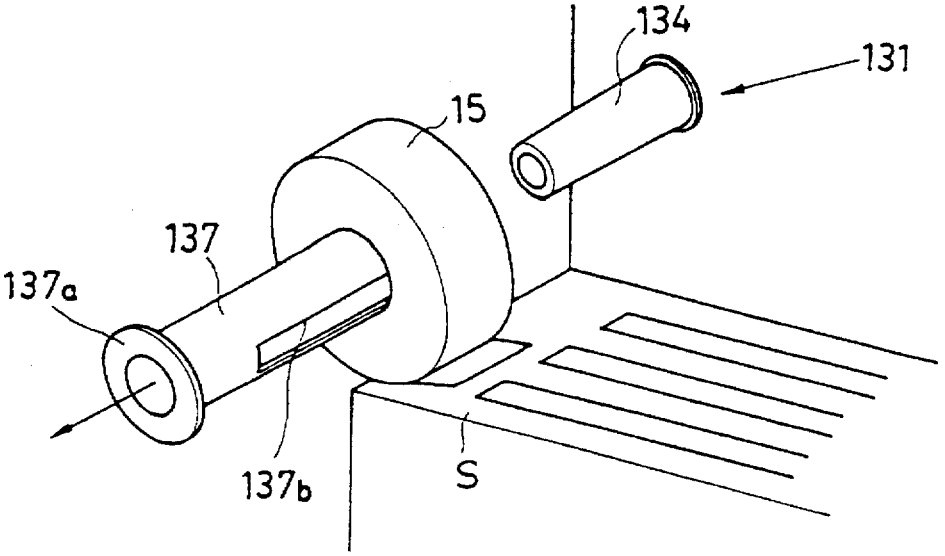
FIG. 20 is a perspective view showing the state where the continuous roll of paper 15 together with a winding sleeve 137 is disengaged from a winding shaft body 134 after the continuous roll of paper 15 is wound around the winding sleeve 137 by a predetermined amount of winding.
Figure 21:
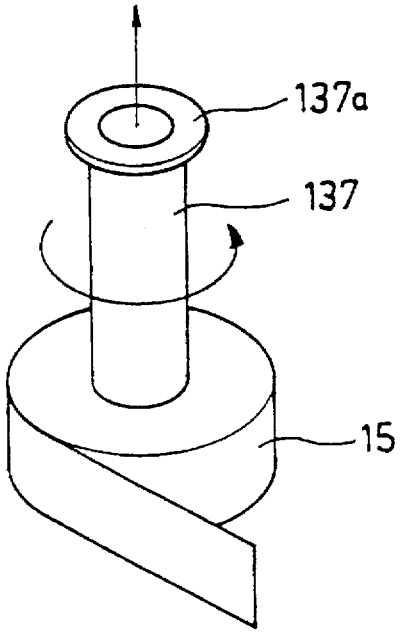
FIG. 21 is a perspective showing the state where the continuous roll of paper 15 is detached from the winding sleeve 137 after the continuous roll of paper 15 of FIG. 20 is wound by the predetermined amount of winding.
Figure 22:
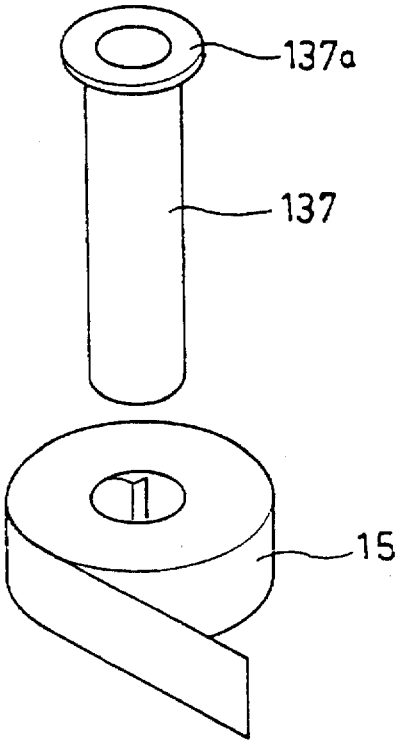
FIG. 22 is a perspective view showing the state where the continuous roll of paper 15 is detached from the winding sleeve 137 after the continuous roll of paper 15 of FIG. 20 is wound by the predetermined amount of winding.

Upon completion of the paper winding operation, the continuous roll of paper 15 is pulled out from the winding shaft body 134 together with the winding sleeve 137 as illustrated in FIG. 20. The winding sleeve 137 is detached from the wound continuous roll of paper 15, if the winding sleeve is pulled out from the continuous roll of paper 15 as illustrated in FIG. 22, while the winding sleeve 137 is turned counter-clockwise (unwinding direction) as illustrated in FIG. 21.

Figure 23:
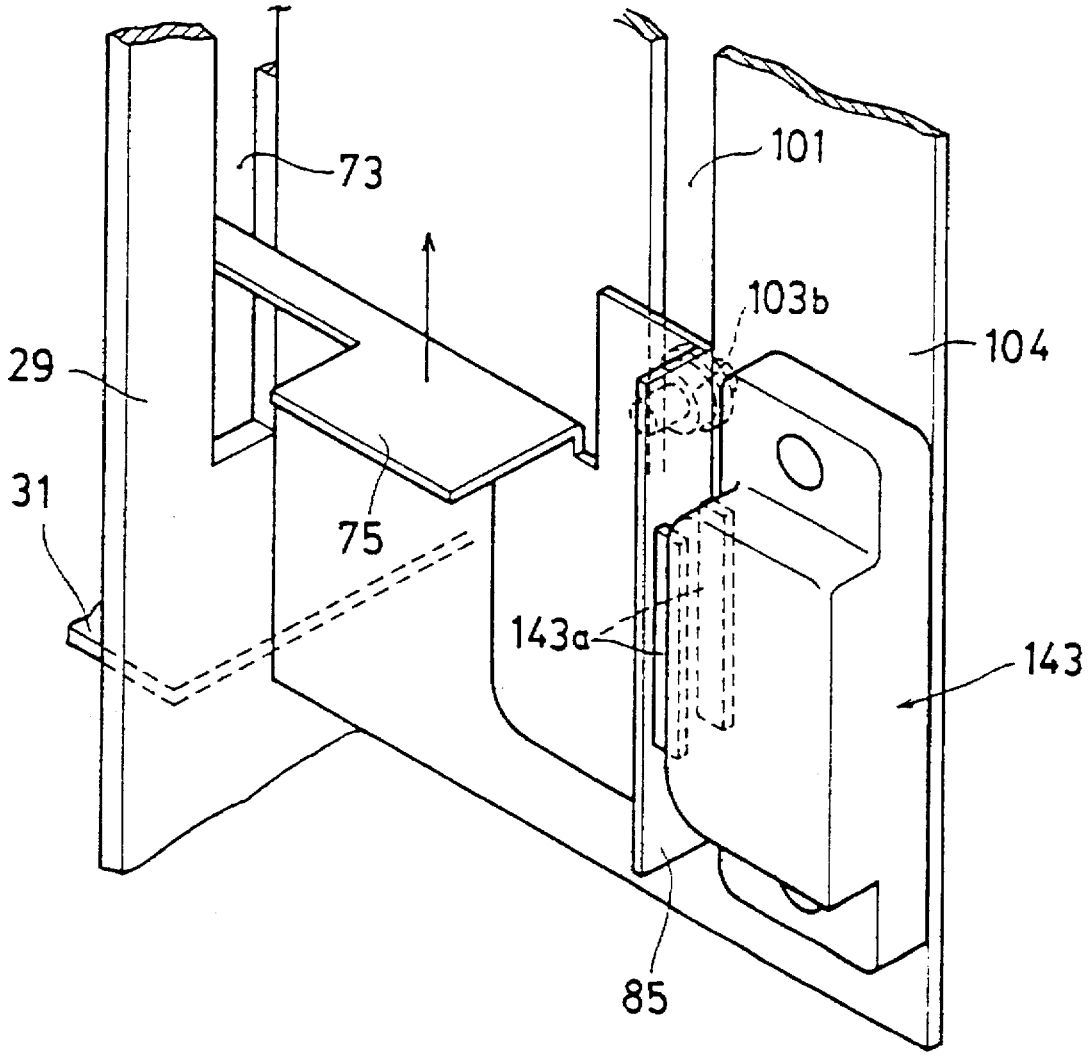
FIG. 23 is a perspective view of a press force switching facilities according to another modification of the present invention.

FIG. 23 is a perspective view showing a modification of a press force switching facilities in which elements corresponding to those as illustrated in FIGS. 9 and 10 are denoted with the same numerals and the explanation thereof is omitted.

According to the modified press force switching facilities, a magnet 143 is fixed to the guide plate 104. A magnet member 143*a* of the magnet 143 is disposed at a position where the shutter 85 of the paper press 75 can adhere the magnet member 143*a*. The magnet 143 applies the press force to the paper press 75 so that the press force acts on the paper press 75 for giving resistance to the rising of the paper press 75 in order to restrain the paper press 75 from rising.

The height direction of the magnet member 143*a* is set to a position where the shutter 85 adheres to the magnet member 143*a* when the height of the paper press 75 is lower than the height h as illustrated in FIG. 9 Accordingly, in a case where the paper press 75 is raised when the number of papers 27 stacked on the bottom plate 31 is relatively small, a resistance force representing μf (the product of the adhering force of the magnet 143 and a friction coefficient μ) is generated on the friction surface between the magnet member 143*a* and the shutter 85.

The adhering force of the magnet 143, corresponding to the biasing force of the spring 82, as illustrated in FIGS. 9 and 10, is applied to the paper press 75 as a load, while the shutter 85 integrated with the paper press 75 adheres to the magnet member 143*a* of the magnet 143. Furthermore, as the stack height of the papers on the bottom plate is increased, the paper press 75 is pushed upward by the rising papers. If the paper press 75 exceeds a predetermined height (corresponding to the height h as illustrated in FIG. 9), the shutter 85 is moved away from the magnet member 143*a*.

As a result, the shutter 85 does not adhere to the magnet 143 so that only the weight of the paper press 75 is applied to the top paper of the stacked papers in the same way as the case of the press force switching facilities as illustrated in FIG. 9.

Accordingly, the paper press 75 is smoothly raised thereafter there is not resistance by the sacked papers. Such a rising of the paper press 75 continues until it reaches the stackful height, i.e., the height where the detecting portion of the stack full sensor 83 (as illustrated in FIG. 6, but omitted in FIG. 23) is shaded by the shutter 85.

If the paper press 75 is lowered to the lowest position after the stacked papers 75 are removed from the bottom plate 31, the shutter 85 again adheres to the magnet member 143*a* of the magnet 143 so that the stacker is returned to the state where the papers begin to stack on the bottom plate 31.

Figure 24:
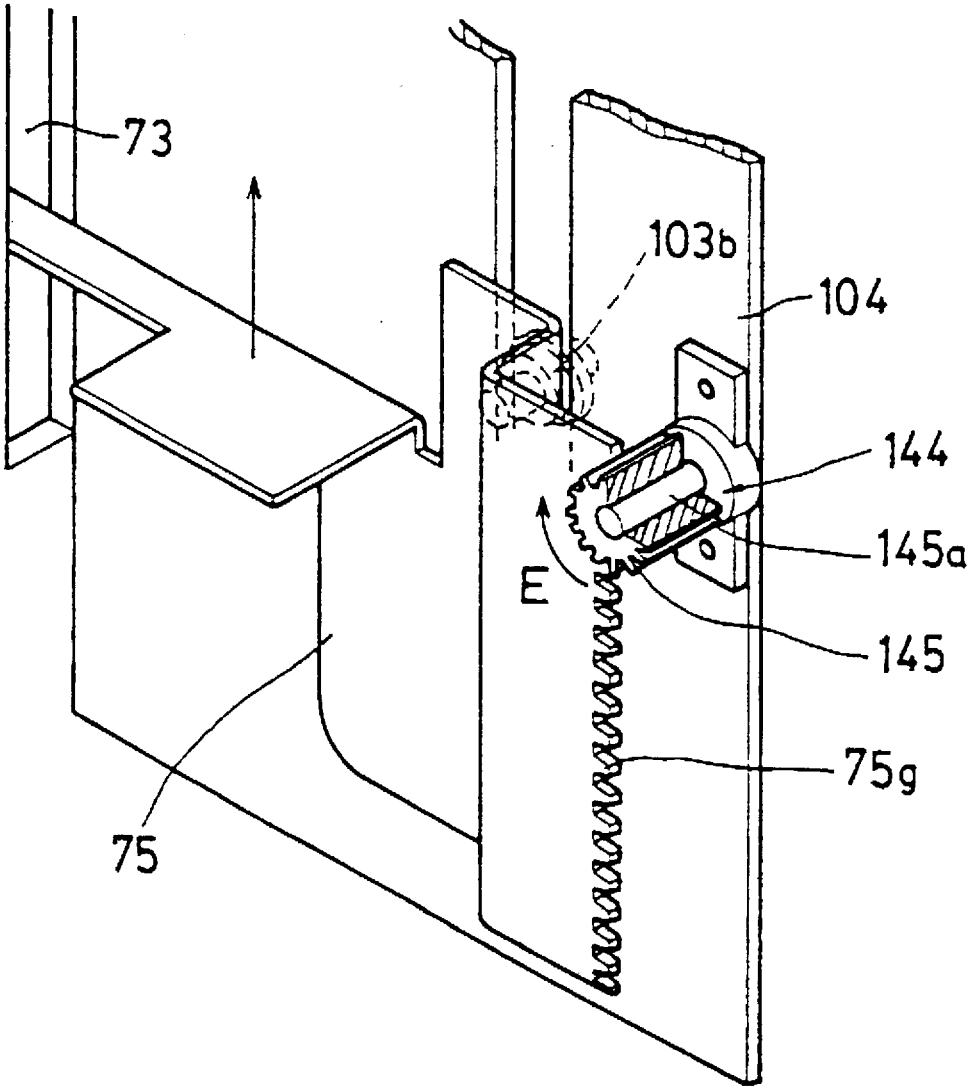
FIG. 24 is a perspective view of a press force switching facilities according to another modification of the present invention.

FIG. 24 is a perspective view of the press force switching facilities of another modification of the invention in which the elements corresponding to those of FIG. 23 are denoted with the same numerals and the explanation thereof is omitted.

According to the press force switching facilities as illustrated in FIG. 24, a rotary damper 144 having a pinion 145 is attached to the guide plate 104. A pinion supporting shaft 145*a*, integrated with the pinion 145, is disposed on and perpendicular to the guide plate 104 so that the pinion 145 is turned about the pinion supporting shaft 154*a*. A rack 75*g* is formed at the portion which is extended from the paper press 75 at one end and the pinion 145 meshes with the rack 75*g*.

The rotary damper 144 gives resistance to the pinion 145 when the pinion 145 is turned clockwise in the direction of arrow E as illustrated in FIG. 24. Accordingly, if the paper press 75 is raised at the position where the pinion 145 meshes the rack 75*g*, the resistance of the rotary damper 144 acts on the paper press 75.

the height where the pinion 145 no longer meshes with the rack 75*g* is set to the height where the paper press 75 reaches the height h as explained with reference to FIG. 9.

Accordingly, if the paper press 75 is raised as the stack height of the papers rises and then exceeds the prescribed height (height h in FIG. 9), the pinion 145 no longer meshes with the rack 75*g*. Thereafter, only the weight of the paper press 75 is applied to the top paper of the stacked papers like in the case of the press force switching facilities as illustrated in FIG. 9. As is evident, the resistance of the rotary damper 144 acts on the top paper of the stacked papers as the only weight when the pinion 145 meshes with the rack 75*g*.

If the stacked papers are taken out form the bottom plate 31 and the paper press 75 is lowered upon completion of the stacking of the papers, the pinion 145 meshes with the rack 75*g* during the lowering of the paper press 75. Whereupon, the rotary damper 144 is constructed not to apply any load to the pinion 145 when the pinion 145 is turned counter-clockwise. Accordingly, the pinion 145 keeps being turned by a slight load without being resisted by the rotary damper 144 and is returned to the stacking beginning position.

A still further modification does not employ the rack and the pinion but includes a friction roller supported by the guide plate 104 serving as the rotary damper, while the paper press 75 has a frictional contact surface which contacts the friction roller, which has the same effect as the modification of the press force switching facilities as set forth just above.

In the modifications as illustrated in FIGS. 23 and 24, if the magnet 143 and the rotary damper 144 are positioned so as to be adjustably movable in the paper stacking direction as explained with reference to FIG. 11, the operation range of the load, serving as the press force acting on the paper press 75 from the magnet 143 or the rotary damper 14, can be arbitrarily varied, which makes the function of the paper press 75 more convenient.

What is claimed is:

1. In an apparatus for stacking sheets of paper by inserting each successive sheet of paper beneath a previously stacked sheet of paper, a press force control apparatus comprising:

a paper press for pressing a top surface of said sheets of paper, after said sheets of paper have been placed in a stacked position, wherein said paper press is translatable up and down with respect to a stack height of said sheets of paper;

a press force switching means for dually functioning to contact said paper press to apply a press force to said paper press and thus hold said paper press in a downwardly translated position, wherein said paper press transfers said press force to said sheets of paper in said stacked position until said stack height of said sheets of paper in said stacked position reaches a predetermined value and to release said press force when said stack height of said sheets of paper exceeds said predetermined value.

2. The press force control apparatus according to claim 1, wherein said press force switching means is provided with a means for controlling said stack height above which said press force is released.

* * * * *